US007789480B2

(12) United States Patent
Shindo

(10) Patent No.: US 7,789,480 B2
(45) Date of Patent: Sep. 7, 2010

(54) PACKAGING STRUCTURE OF INKJET HEAD

(75) Inventor: Tatsuya Shindo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 860 days.

(21) Appl. No.: 11/580,726

(22) Filed: Oct. 13, 2006

(65) Prior Publication Data

US 2007/0085884 A1 Apr. 19, 2007

(30) Foreign Application Priority Data

Oct. 13, 2005 (JP) ..... 2005-298919

(51) Int. Cl.
*B41J 2/165* (2006.01)
*B41J 2/175* (2006.01)

(52) U.S. Cl. ..... 347/22; 347/29; 347/87

(58) Field of Classification Search ..... 347/22, 347/29, 31, 87; 222/105
See application file for complete search history.

(56) References Cited

U.S. PATENT DOCUMENTS 4,543,589 A * 9/1985 Terasawa ..... 347/31
5,182,581 A * 1/1993 Kashimura et al. ..... 347/87
5,231,416 A * 7/1993 Terasawa et al. ..... 347/23
5,262,802 A * 11/1993 Karita et al. ..... 347/87
6,247,598 B1 * 6/2001 Hosaka et al. ..... 206/723
6,409,325 B1 * 6/2002 Matsumoto et al. ..... 347/87
6,729,717 B2 5/2004 Ito et al.
7,063,405 B2 6/2006 Ito et al.

FOREIGN PATENT DOCUMENTS

JP 10272784 10/1998
JP 11240234 * 9/1999
JP 2001219560 8/2001
JP 2002-67312 3/2002

* cited by examiner

*Primary Examiner*—Anh T. N. Vo
(74) *Attorney, Agent, or Firm*—Frommer Lawrence & Haug LLP

(57) ABSTRACT

A packaging structure of an inkjet head for transporting thereof with a liquid stored therein, the inkjet head including an ink inlet of ink supplied from an ink source and a nozzle communicated with the ink inlet for discharging the ink to a recording medium, comprises a first packaging member including a cap for covering an opening of said nozzle, the first packaging member being detachably attached to the opening of said nozzle, and a second packaging member including an ink absorbing material for covering said ink inlet, the second packaging member being detachably attached to said ink inlet.

21 Claims, 17 Drawing Sheets

PACKAGING STRUCTURE OF INKJET HEAD

CROSS-REFERENCE OF RELATED APPLICATION

This nonprovisional application claims priority under 35 U.S.C. §119(a) on Patent Application No. 2005-298919 in Japan on Oct. 13, 2005, the entire contents of which are hereby incorporated by reference.

BACKGROUND

The present invention relates to a packaging structure for packaging an inkjet head with ink or preserving liquid stored therein.

Generally, an inkjet head is shipped from a plant in a state being incorporated in a main body of an image-recording unit or the like. However, when an inkjet head itself has to be, for example, repaired or replaced with a new one, the inkjet head is sometimes transported in a state being removed from the unit. The inkjet head is provided with ink inlets for supplying ink directly or through an ink supply tube from ink sources. When the inkjet head is transported, the ink inlets are disconnected from the ink source or ink supply tube. Therefore, not only nozzles but the ink inlets are also opened, which allows the inside of the inkjet head to communicate with the outside.

Ordinarily, the inkjet head removed from the unit has been filled with ink therein. The remaining ink occasionally leaks out to the outside from the opening portion such as nozzles or ink inlets due to air expansion due to changes of ambient temperature and/or air pressure during the transportation (by land, sea, air cargo transportation or the like) resulting in a ambient pollution.

To prevent this, it is conceivable to cover to seal the nozzles and the ink inlets with a cap or the like. However, although the leakage to the outside can be prevented, the ink leaked out inside the cap stay therein. In the case of a color inkjet head, since a plurality of ink colors is mixed with each other inside the cap covering the nozzles, when the air pressure returns to an ordinary pressure, the color mixed ink is drawn back into the inside of the inkjet head causing a pollution inside the head with another color. As a result, there resides such a problem that, when the inkjet head is mounted again onto the unit and the ink is discharged, precise color recording cannot be obtained due to the color mixture.

Also, when the inside of the cap is polluted by the ink, or when a large amount of the ink leaks and flow out from the cap, hands of service person occasionally get dirty while exchanging the head, or surrounding electronic component parts are occasionally polluted.

It is known that the inkjet head is filled with a preserving liquid (an ink liquid without dye) before shipping the same from plant so that the ink can be introduced smoothly when a user uses the inkjet head for the first time. For example, a structure for preventing leakage of the preserving liquid during the transportation (refer to FIG. 1) is disclosed in Japanese Patent Application Laid-Open No. 10-272784. It is conceivable to apply the structure of preventing the liquid leakage to the above-mentioned ink leakage prevention during its transportation. The Japanese Patent Application Laid-Open No. 10-272784 employs such a structure that a rubber cap is attached to the nozzles in order to air-tightly cover the same while keeping a predetermined distance away from the openings of the nozzles; and a cylindrical member, which has a long path communicated with the atmosphere therein, is attached to the ink inlets. It is arranged so that, when the air pressure changes during the transportation, the preserving liquid is allowed to leak out from the ink inlets into the path communicated with the atmosphere so that the preserving liquid is held within the path communicated with the atmosphere; thereby the liquid is prevented from leaking out to the outside.

BRIEF SUMMARY

When the structure of preventing liquid leakage disclosed in the Japanese Patent Application Laid-Open No. 10-272784 (refer to FIG. 1) is apply to the transportation of the inkjet head removed from a unit, same as the case of the preserving liquid, since the ink leaks out first into a long path communicated with the atmosphere, the ink is restricted from leaking from the nozzles. However, when only the inkjet head is transported, compared to the case where the inkjet head is transported along with the unit, since the size of its package is extremely small and the weight is light, the package is not always transported while the up/down direction thereof is held properly. Therefore, when the package is placed upside down, there is a possibility that the ink flows out to the outside from an end portion at the side of path communicated with the atmosphere resulting in pollution.

An object is to provide a packaging structure of inkjet head capable of preventing ink from leaking out to the outside causing pollution as well as preventing pollution such as color mixture or the like of the ink while transporting the inkjet head.

In order to achieve the above object, there is provided a packaging structure of an inkjet head for transporting thereof with a liquid stored therein, the inkjet head including an ink inlet of ink supplied from an ink source and a nozzle communicated with the ink inlet for discharging the ink to a recording medium, comprising: a first packaging member including a cap for covering an opening of said nozzle, the first packaging member being detachably attached to the opening of said nozzle; and a second packaging member including an ink absorbing material for covering said ink inlet, the second packaging member being detachably attached to said ink inlet.

According to the aspect, since the openings of the nozzles of the inkjet head is covered with the cap, when the internal air is expanded due to a pressure change during a transportation of the inkjet head, the ink leaks out first to the outside from the ink inlets side, which is covered with the ink absorbing material superior in permeability than that of the cap. And, since the ink leaked from the ink inlets is immediately absorbed by the ink absorbing material covering the open end of the ink inlets, the ink is prevented from spreading to the surroundings causing pollution thereof.

Since the ink once absorbed by the ink absorbing material is held in an absorbed state and hardly leaks out, even when the inkjet head is placed upside down during its transportation, there is no possibility that the ink leaks out from the ink absorbing material. The above and further objects and features will more fully be apparent from the following detailed description with accompanying drawings.

DETAILED DESCRIPTION

First Embodiment

An embodiment will be described below with reference to FIGS. 1 to 7A and 7B.

Figure 1:
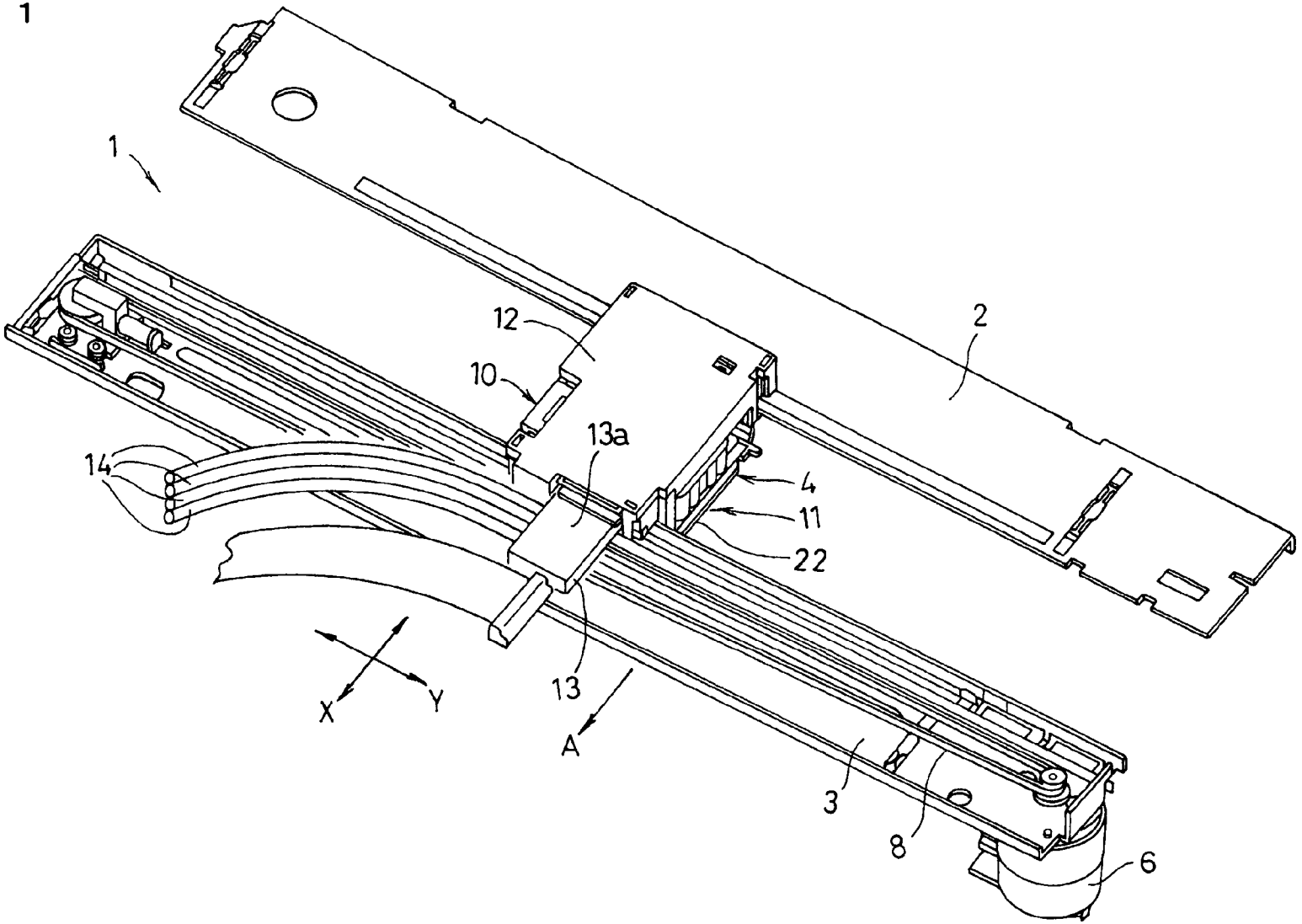
FIG. 1 is a perspective view of a recording section on which an inkjet head (recording head unit) is mounted according to one embodiment.

An inkjet head (hereinafter, referred to as recording head unit) 4 according to the embodiment is mounted on a recording section 1 provided inside a main body frame (not shown) of an inkjet printer as shown in FIG. 1, and discharges ink onto a sheet as a recording medium to performing the recording. The inkjet printer is applied to a multi function device (MFD), which has, for example, a copying function, a scanning function, a facsimile function and the like, as a printing function.

The recording section 1 comprises a recording head unit 4, a timing belt 8, a CR (carriage) motor 6 and the like. The recording head unit 4 composes a carriage mounted on guide rails 2 and 3 having a plate-like shape, which horizontally extends in a Y-direction (a direction orthogonal to a sheet feed direction; primary scanning direction), being bridged between the guide rails 2 and 3 so as to slide forward and backward. The timing belt 8 is dispose parallel to the upper face of the guide rail 3 disposed at the downstream side (a direction of an arrow A in FIG. 1) in an X-direction (a sheet feed direction; secondary scanning direction) to move the recording head unit 4 forward and backward. The CR (carriage) motor 6 drives the timing belt 8.

Figure 2:
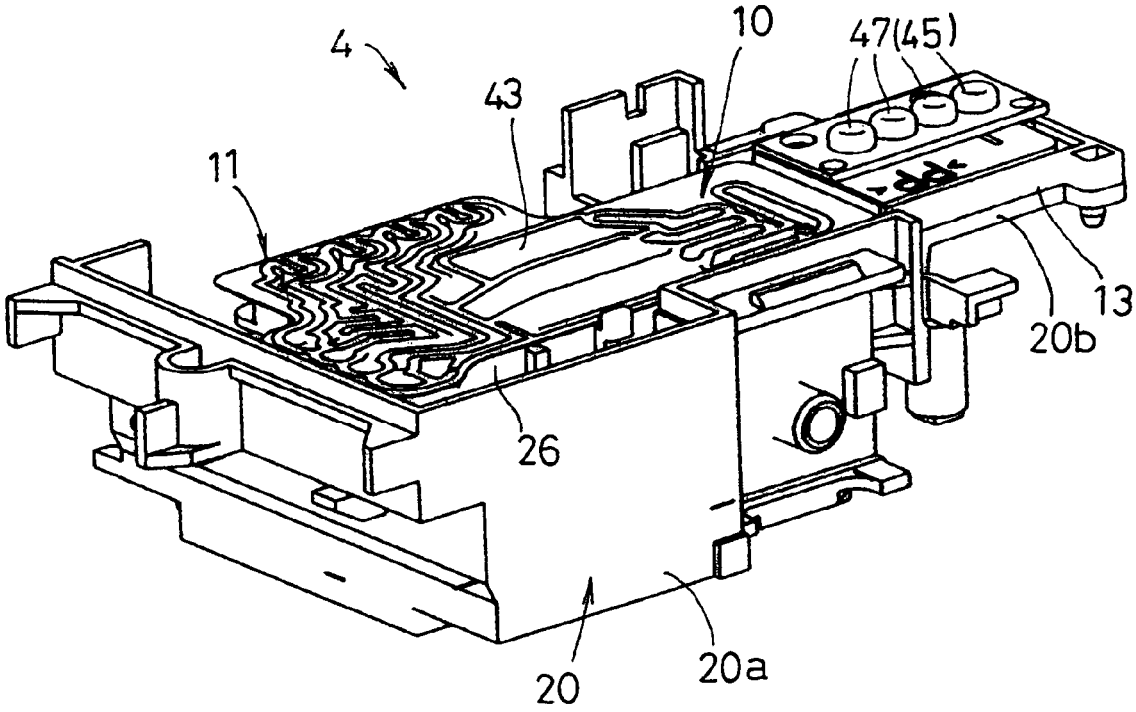
FIG. 2 is a perspective view of the recording head unit.
Figure 3:
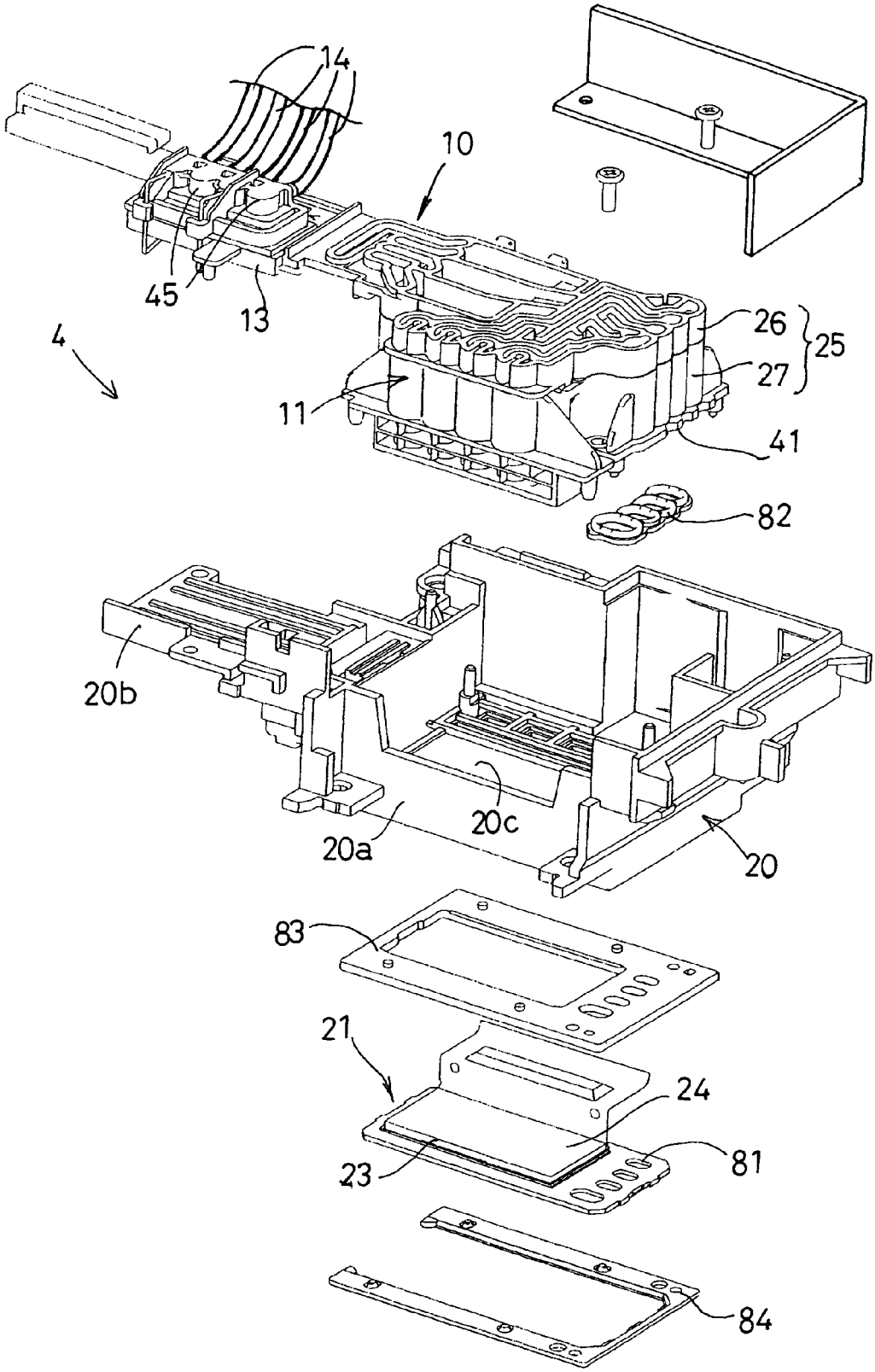
FIG. 3 is an exploded perspective view of the recording head unit.

The recording head unit 4 is equipped with a head holder 20, which has a box-like body portion 20*a* and a coupling support piece 20*b* extending from the body portion 20*a* toward the downstream in the sheet feed direction (a direction of the arrow A in FIG. 1) as shown in FIG. 2 and FIG. 3. The recording head unit 4 is further equipped with an inkjet-type recording head 21 fixed to the lower side of a bottom plate 20*c* of the head holder 20. The recording head unit 4 is further equipped with a dumper unit 10 and an exhaust valve unit 11, which are fixed to the upper side of the bottom plate 20*c*.

The dumper unit 10 is provided with a coupling piece 13, which extends almost horizontally toward the downstream in the sheet feed direction (a direction of the arrow A in FIG. 1) and supported by the coupling support piece 20*b* being overlapped therewith. The dumper unit 10 is arranged to connect with front-end portions of ink supply tubes (ink tubes) 14. Within the main body frame of the inkjet printer, separate ink tanks (not shown) are stably disposed as the ink sources for full color recording; i.e., yellow ink (Y), magenta ink (M), cyan ink (C) and black ink (Bk). Base end portions of the ink supply tubes 14 are connected to each of the ink tanks; and front-end portions thereof are connected to supply tube connecting ports 47 of the dumper unit 10 being interposed by connecting members 45. In this embodiment, since there are four ink colors, four ink supply tubes 14 are provided. However, kind of ink colors, number of ink supply tubes and the like are not limited to the above.

The recording head 21 is provided with nozzles 22 having openings at the lower side thereof. The recording head unit 4 is formed with ink flow paths connecting the supply tube connecting ports 47 and the nozzles 22 therebetween. And the dumper unit 10 is provided in the halfway of the ink flow paths of the recording head unit 4. The dumper unit 10 is for absorbing pressure fluctuation, which is applied to the ink due to an inertial force in the ink supply tube 14, utilizing a dumping effect by the air. The upper face of the dumper unit 10 and the exhaust valve unit 11, and the upper face of the dumper unit 10 and the coupling piece 13 are covered respectively with lid cover members 12 and 13*a* (refer to FIG. 1).

Figure 4:
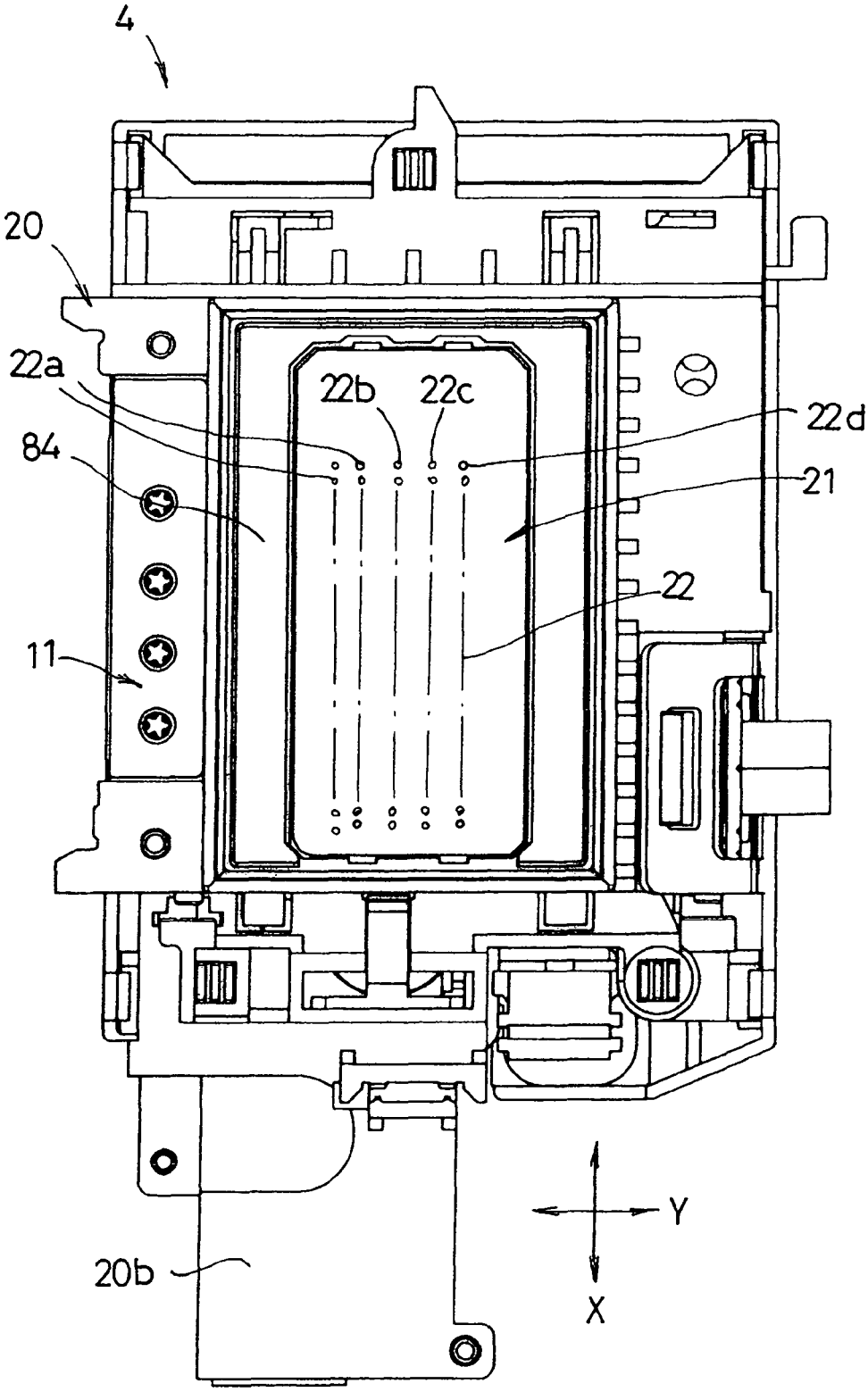
FIG. 4 is bottom view of the recording head unit.

A plurality of nozzles 22 is formed in a lower face of the recording head 21. There are disposed, from the left side, two rows of nozzles 22*a*, 22*a* for the black ink (Bk), a single row of nozzles 22*b* for the cyan ink (C), a single row of nozzles 22*c* for the yellow ink (Y) and a single row of nozzles 22*d* for the magenta ink (M) (total five rows) as shown in FIG. 4 (a view of the recording head 21 viewed from the bottom). Each of the nozzle rows is formed longer in a direction orthogonal to a moving direction of the carriage (Y-direction, primary scanning direction), and faces to the upper face of the sheet as the recording medium.

The recording head 21 has ink supply ports 81 for each ink color on one side of the upper face thereof as disclosed in Japanese Patent Application Laid-Open No. 2002-67312, Japanese Patent Application Laid-Open No. 2001-219560 and the like. The Ink is distributed to a plurality of pressurizing chambers through each of ink supply channels (manifolds) extending from the ink supply ports 81. The ink is discharged from the nozzles 22 by driving actuators 23 such as piezoelectric elements corresponding to the respective pressurizing chambers. The actuators 23 are provided with a flexible flat cable 24 for impressing a voltage to the actuators 23 fixed to the upper face thereof as shown in FIG. 3. The recording head 21 is attached to the lower side of the bottom plate 20*c* of the head holder 20, and a reinforcement frame 83 is interposed between the recording head 21 and the bottom plate 20*c* to prevent the attached recording head 21 from warping.

A head connecting port 41 (which will be described later) of the dumper unit 10 is inserted into an opening of the bottom plate 20*c*. The ink supply ports 81 and the head connecting ports 41 of the dumper unit 10 are communicated with each other through an opening formed in the reinforcement frame 83. The ink supply ports 81 and the head connecting ports 41 of the dumper unit 10 are provided with a sealing member 82 such as a rubber packaging between them. Further, the recording head 21 is provided with a front frame 84 having a U-like shape for eliminating a step on a nozzle face, which is attached to the nozzle face (lower) side of the recording head 21.

Figure 5A:
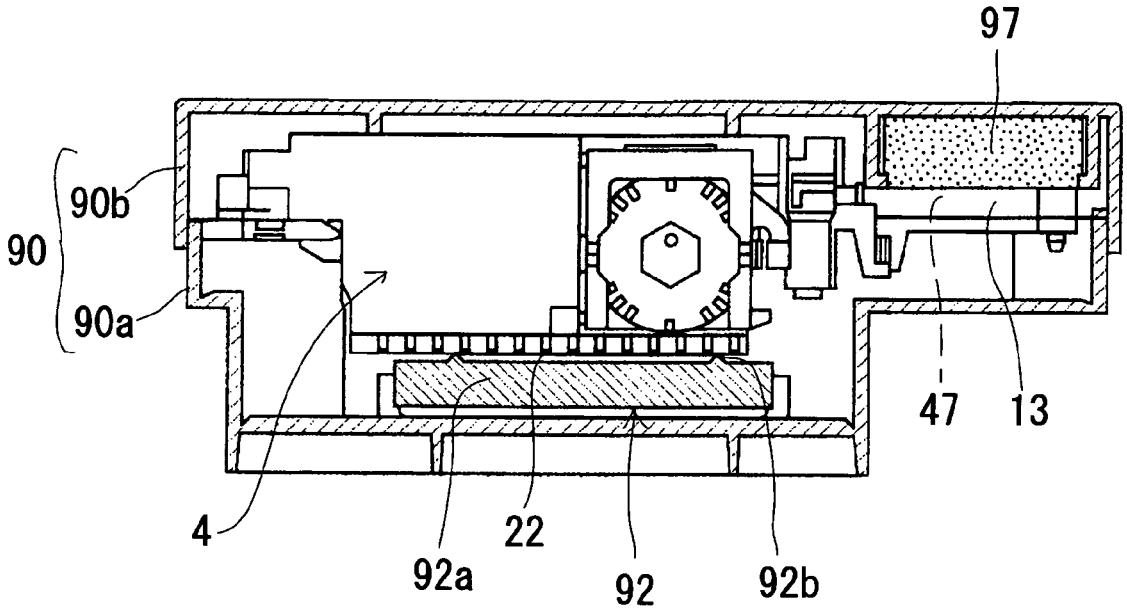
FIG. 5A is a longitudinal section showing a packaging structure according to an embodiment.

When repairing or replacing with a new one, the recording head unit 4 structured as described above is disconnected from the ink supply tube 14 and taken out from the recording section 1. Open face of the nozzles 22 is covered air-tightly with a cap 92 leaving a space so as not come into contact with the openings of the nozzles 22 as shown in FIG. 5A; and the supply tube connecting ports 47 are covered with an ink absorbing material 97. In this state, the recording head unit 4 is stored in a container 90 designated for transportation thereof, and transported to a service shop.

Figure 5B:
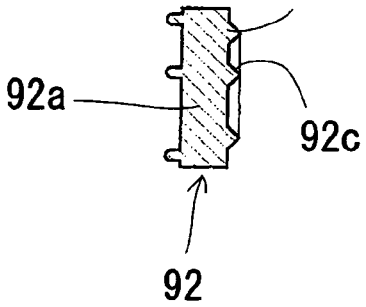
FIG. 5B is a plan view of a cap.
Figure 5C:
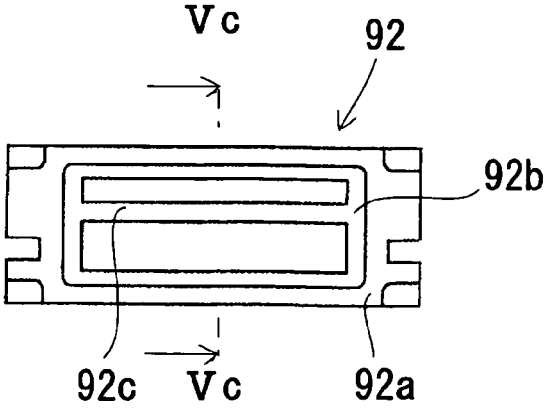
FIG. 5C is a sectional view taken from a line Vc-Vc in FIG. 5B.
Figure 6:
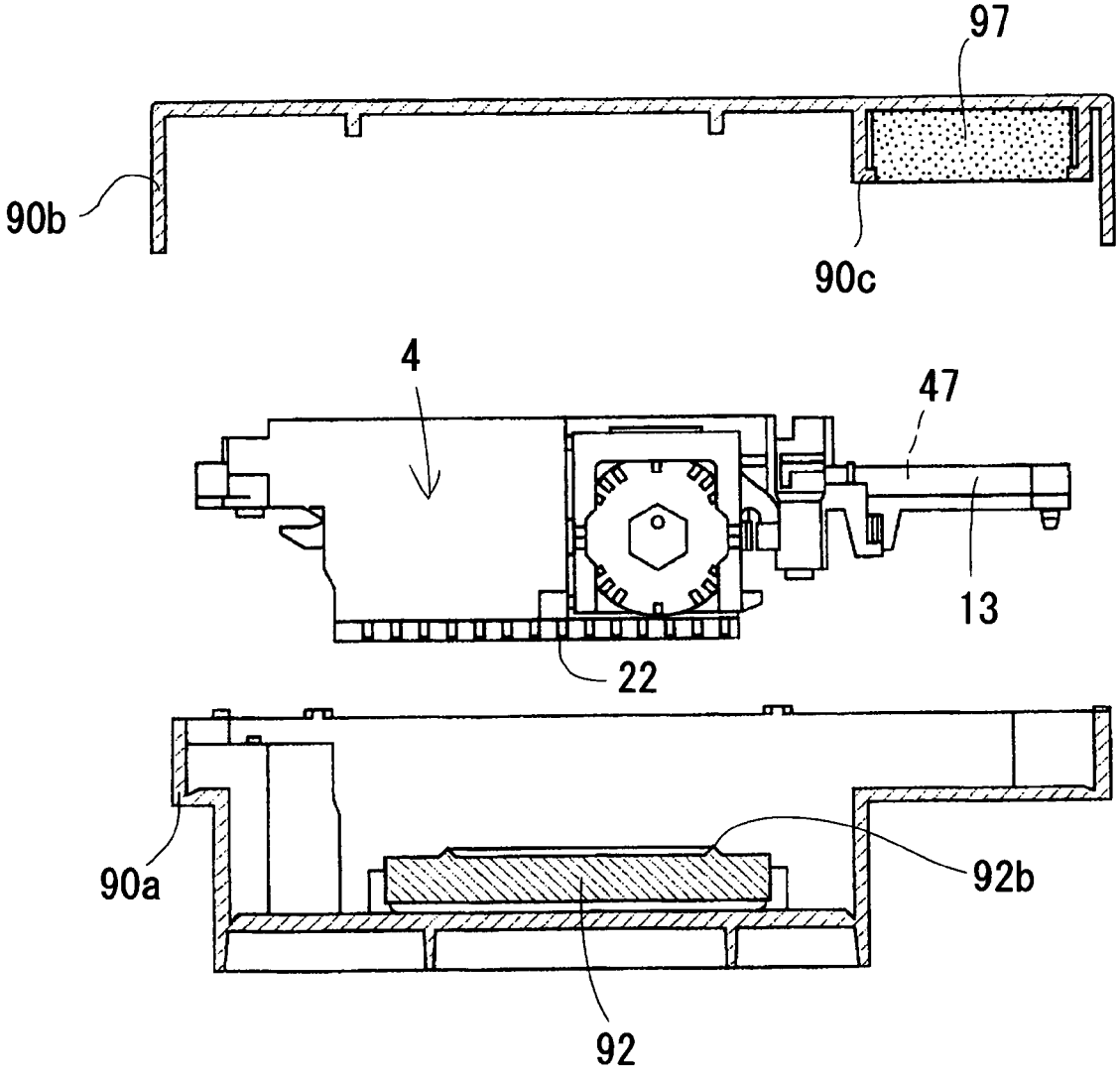
FIG. 6 is an exploded longitudinal section of the packaging structure according to an embodiment.

The container 90 is composed of a box-like main body 90*a* with an open upper face and a cover member 90*b* to cover the main body 90*a* as shown in FIG. 6. The cap 92 is previously bonded to the bottom face of the main body 90*a* with an adhesive or the like. The cap 92 is made of a rubber-like elastic material. The cap 92 is integrally formed with a peripheral wall portion 92*b* from the base portion 92*a* thereof having a rectangular shape viewed from the top, which entirely encloses around the nozzle rows (here, five rows) as shown in FIGS. 5A to 5C. Also, inside the peripheral wall portion 92*b*, a partitioning portion 92*c* for partitioning five nozzle rows into two rows for black, and three rows for other colors are integrally formed. The partitioning portion 92*c* may be omitted. Further, the cap 92 may be arranged so as to detachably attach to the open face of the nozzles 22 without being fixed to the main body 90*a*.

On the other hand, in a portion corresponding to the supply tube connecting ports 47 inside the cover member 90*b* of the container 90, the ink absorbing material 97 is disposed as shown in FIG. 5A and FIG. 6. The ink absorbing material 97 is formed so as to cover the openings of at least the four supply tube connecting ports 47. As a material for the ink absorbing material 97, for example, a material having an ink absorbing characteristic such as porous foam resin, a felt material, a sponge material or the like is selected. Therefore, the supply tube connecting ports 47 are communicated with the atmosphere owing to the permeability of the ink absorbing material 97 itself In this embodiment, a rib 90*c* having L-like shape in cross-section is protruding vertically downward from the cover member 90*b* enclosing the outer periphery of the ink absorbing material 97. An ink absorbing material 97 inserted inside the rib 90*c* and held thereby. Since the cover member 90*b* does not enclose the outer periphery surface of the ink absorbing material 97 in an air-tight manner, the supply tube connecting ports 47 is easily communicated with the atmosphere. However, air-communicating holes penetrating the cover member 90*b* may be additionally formed in the periphery in a portion where the ink absorbing material 97 is held.

Figure 7A:
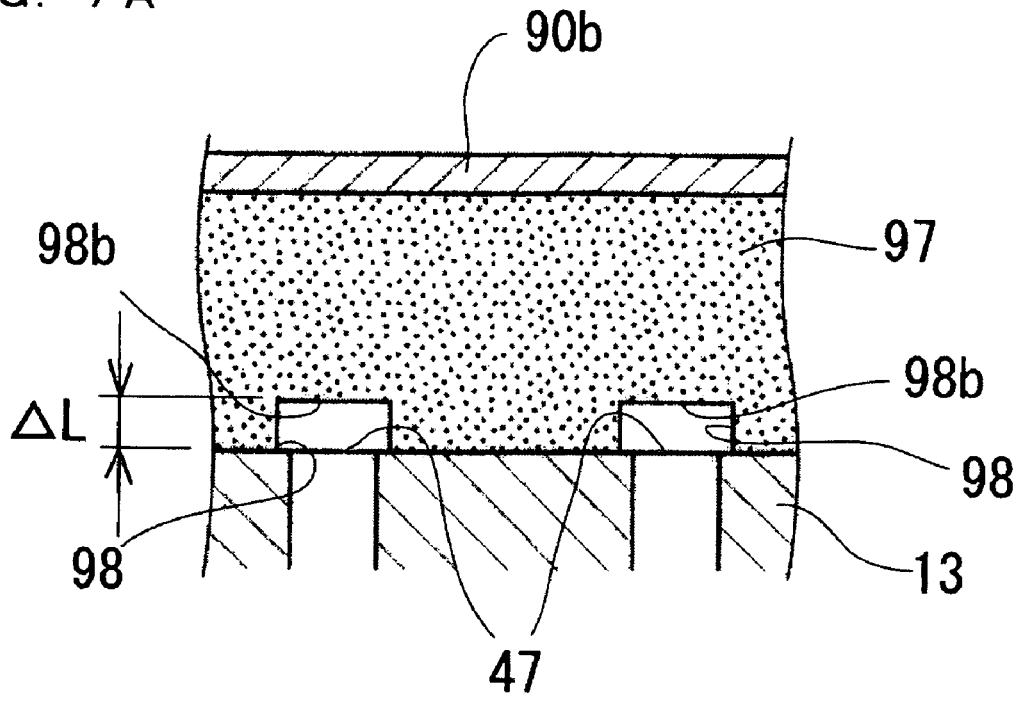
FIG. 7A is a longitudinal section showing an ink absorbing material of an embodiment.

The ink absorbing material 97 is formed with recessions 98 of ΔL in depth at positions corresponding to the respective supply tube connecting ports 47 as shown in FIG. 7A. Open end faces of the recessions 98 (lower face of the ink absorbing material 97) and open end faces of the supply tube connecting ports 47 (upper face of the coupling piece 13) are in a close contact with each other.

Further, the main body 90*a* and cover member 90*b* of the container 90 are formed with guide portions (not shown) arranged with ribs, concaves and convexes to facilitate the recording head unit 4 to be mounted at a desired position. Accordingly, the recording head unit 4 has only to be set inside the main body 90*a* along the guide portions, in order that the cap 92 is fitted to a proper position of the open face of the nozzles 22. And the cover member 90*b* has only to be fitted to the main body 90*a* in the same manner, in order that four recessions 98 of the ink absorbing material 97, which is held by the cover member 90*b*, are positioned properly to the four supply tube connecting ports 47 respectively, and the ink absorbing material 97 is brought into a close contact with the upper face of the coupling piece 13. Then, the main body 90*a* is fixed (detachably) to the cover member 90*b* with a fastener or hook (not shown). At this time, the cap 92 elastically deforms appropriately to air-tightly seal the open face of the nozzles 22. At the same time, a repulsive force generated by the elastic deformation of the cap 92 energizes the ink absorbing material 97 attached to the cover member 90*b* toward the supply tube connecting ports 47. Owing to this, the close contact between the lower face of the ink absorbing material 97 and the upper face of the coupling piece 13 is increased. In particular, although the ink absorbing material 97 is brought into a close contact with the upper face of the coupling piece 13 so as to seal the supply tube connecting ports 47, the supply tube connecting ports 47 are ensured to be communicated with the atmosphere through many fine holes or cavities included in the ink absorbing material 97 itself.

Owing to this arrangement, while the recording head unit 4 is transported, when the internal air expands to a positive pressure due to a change of air pressure, the ink leaks out first through the supply tube connecting ports 47 communicated with the atmosphere being interposed by the ink absorbing material 97 prior to the openings of the nozzles 22 sealed by the cap 92. The leaked ink is immediately absorbed by the ink absorbing material 97, which covers the supply tube connecting ports 47.

When the inside air pressure changes to a negative pressure, a force acts to draw the ink or air into the recording head unit 4 from the outside. However, since the open end faces of the supply tube connecting ports 47 is parted away from the bottom face 98*b* of the recessions 98 by ΔL without being contacted therewith, the atmosphere within the recessions 98 is drawn into the head prior to the ink absorbed in the ink absorbing material 98. Furthermore, depending on the amount of the ink absorbed in the ink absorbing material 97, when a negative pressure is generated, once an air communication path is formed between the outside and the recessions 98, the atmosphere is drawn through the air communication path only. Therefore, the previously absorbed ink is not drawn into the recording head unit 4 again. Therefore, even when the ink leaked from the recording head unit 4 is mixed with another color in the ink absorbing material 98, there is no possibility of pollution by the mixed ink returned into the recording head unit 4.

Figure 7B:
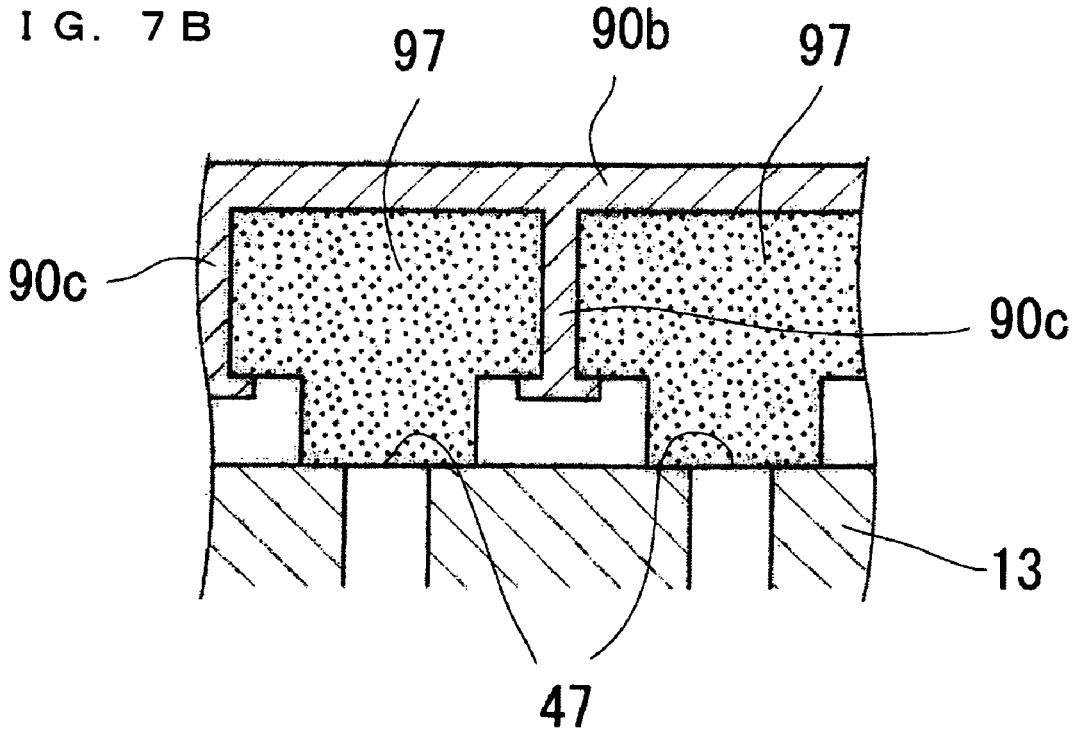
FIG. 7B is a longitudinal section showing an ink absorbing material of a modification of the embodiment.

In order to prevent the color mixture of ink in the ink absorbing material 97 further reliably, the ink absorbing material 97 may be modified so as to be disposed corresponding to each of the supply tube connecting ports 47 as shown in FIG. 7B. In this modification, the ink absorbing material 97 is partitioned by ribs 90*c*, which extends vertically from the cover member 90*b*. In this case, the ink is prevented from being mixed with another color ink in the ink absorbing material 97. Even if the leaked ink returns to the recording head unit 4, since the identical color ink only returns, no pollution due to the color mixture occurs inside of the head.

Therefore, different from the above-described embodiment, it not necessary to ensure a space for the atmosphere adjacent the supply tube connecting ports 47 by forming the recessions 98. That is, the openings of the supply tube connecting ports 47 may be directly covered with the ink absorbing material 97 as shown in FIG. 7B to increase the ink capturing performance. Needless to say, in view of preventing the leaked ink from returning to the recording head unit 4 again, by combining the structures shown in FIGS. 7A and 7B, the ink absorbing material 97 may be provided to each of the supply tube connecting ports 47 and the recessions 98 may be formed corresponding to each of the supply tube connecting ports 47.

Second Embodiment

Next, another embodiment will be described with reference to FIG. 8 to FIGS. 11A and 11B. The embodiment is arranged so that the supply tube connecting ports 47 are not directly covered with the ink absorbing material 97 but the supply tube connecting ports 47 are attached with connecting member 91 for transportation and covered with the ink absorbing material 97.

The connecting member 91 for transportation is made from synthetic resin having a substantially rectangular solid shape as shown in FIGS. 9A and 9B and FIGS. 11A and 11B and overlapped with the upper side of the coupling piece 13. The connecting member 91 for transportation is formed with four internal paths 93, which penetrate through the connecting member 91 in its thickness direction and separately connected to the four supply tube connecting ports 47. The internal paths 93 further penetrate through cylindrical portions 94, a side of which opposite to the supply tube connecting ports 47 is formed extending long. The four cylindrical portions 94 are disposed in line, and engagement pieces 95 extend vertically downward from two side faces of the connecting members 91, which are parallel to each other in the disposition direction. Each of the engagement pieces 95 is formed with a hook 95*a* extending inward opposing to each other in a lower portion thereof. The connecting member 91 is overlapped with the upper face of the coupling piece 13 being interposed by a seal member 96 made of a rubber-like elastic material. When the two engagement pieces 95 are pulled way from each other and taking advantage of the elasticity thereof the hooks 95*a* are engaged with a lower face of the coupling piece 13 (coupling support piece 20*b*), the connecting member 91 for transportation is fixed to the coupling piece 13 (coupling support piece 20*b*). Contrarily, when disengaging the hooks 95*a*, the engagement pieces 95 are pulled away from each other; thus, the connecting member 91 and the coupling piece 13 (coupling support piece 20*b*) can be easily separated.

Figure 8:
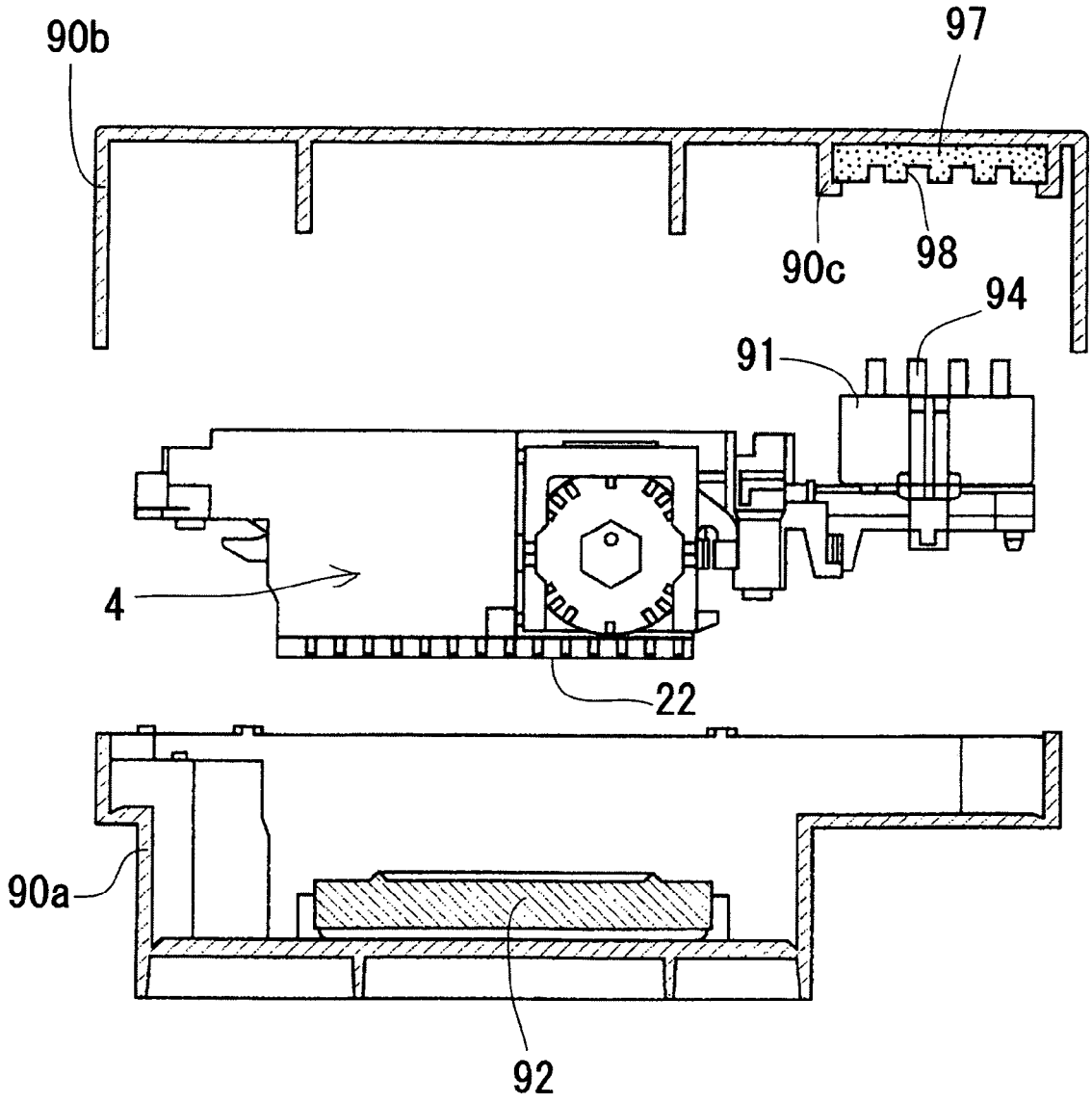
FIG. 8 is an exploded longitudinal section of a packaging structure according to an embodiment.
Figure 9A:
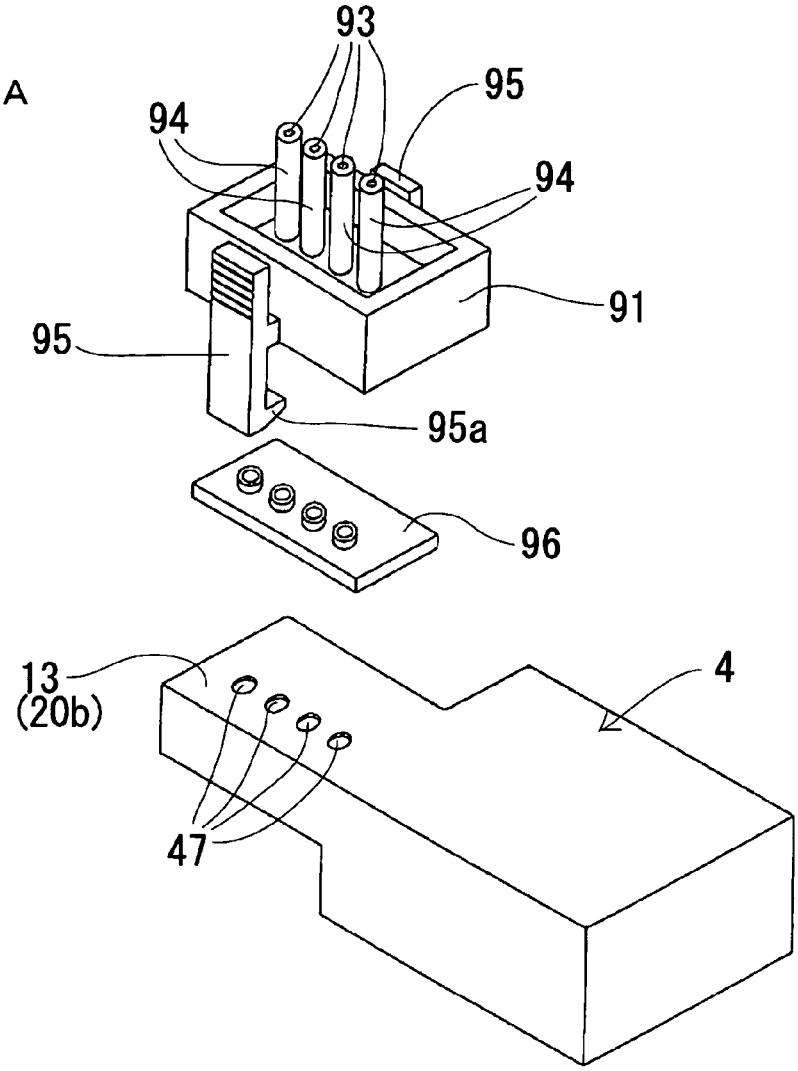
FIG. 9A is an exploded perspective view showing a connecting member for transportation attached to the recording head unit.
Figure 9B:
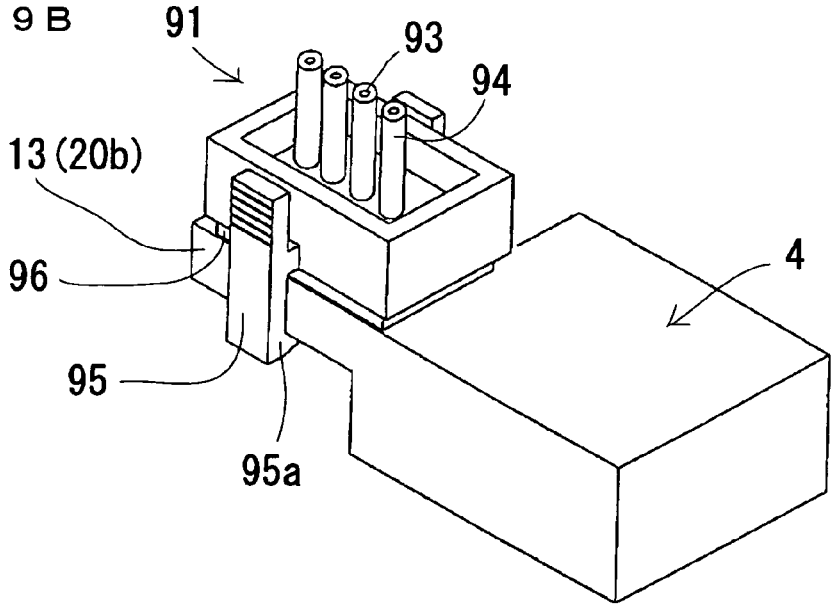
FIG. 9B is a perspective view of the connecting member for transportation attached to the recording head unit.
Figure 10A:
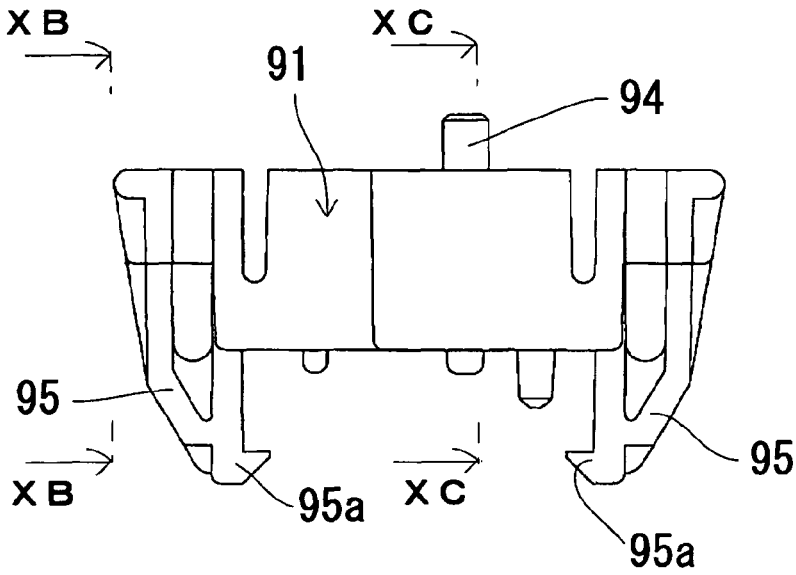
FIG. 10A is a side view of a connecting member for transportation.
Figure 10B:
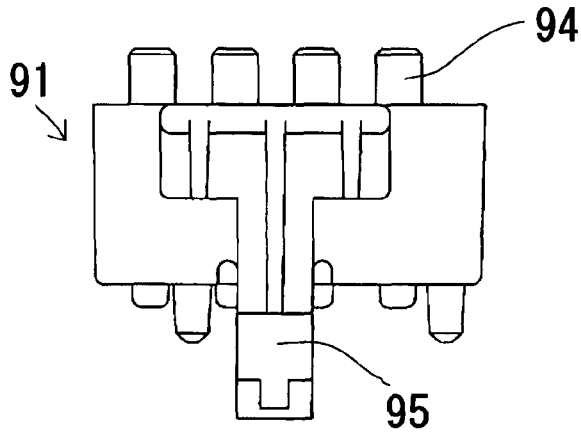
FIG. 10B is a cross-sectional view taken from a line Xb-Xb in FIG. 10A.
Figure 10C:
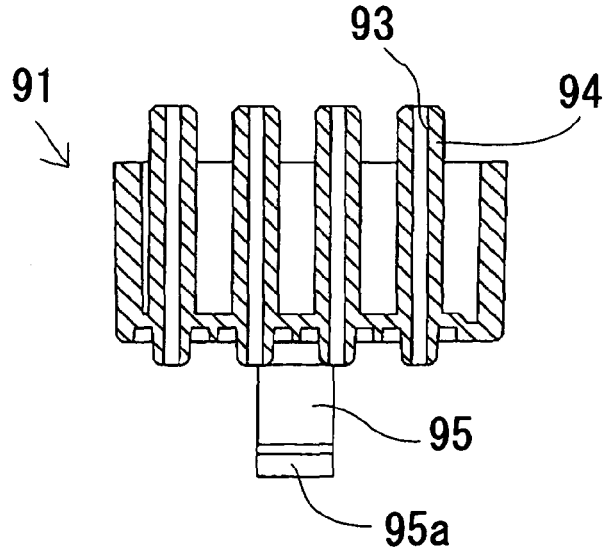
FIG. 10C is a sectional view taken from a line Xc-Xc in FIG. 10A.
Figure 11A:
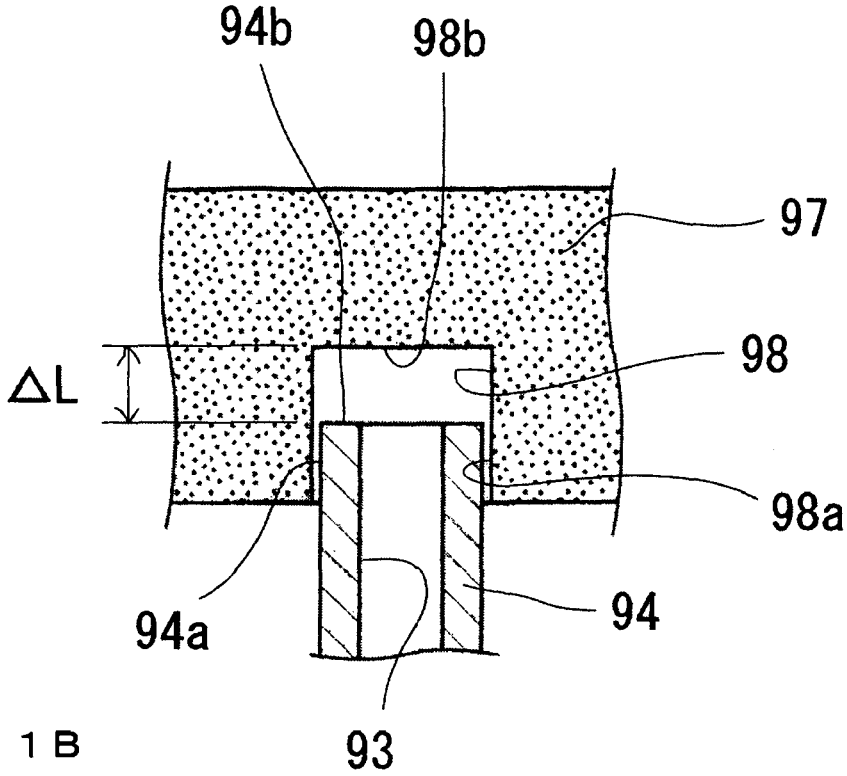
FIG. 11A is a longitudinal section showing an ink absorbing material according to an embodiment.

The cover member 90*b* of the container 90 is disposed with the ink absorbing material 97 in a portion where front ends of the cylindrical portions 94 of the connecting member 91 face thereto as shown in FIG. 8. The ink absorbing material 97 is formed with recessions 98 in positions each corresponding the four cylindrical portions 94 of the connecting member 91 for transportation as shown in FIG. 8 and FIG. 11A; and at least front ends of the cylindrical portions 94 are inserted into the recessions 98. The recessions 98 are formed so that an inner side face 98*a* thereof comes close to or comes into contact with outer circumferential surfaces 94*a* of the cylindrical portions 94 as shown in FIG. 11A; and at the same time, the bottom faces 98*b* are parted away from front end face 94*b* of the cylindrical portions 94 by ΔL. Owing to this arrangement, the ink leaks out to the outside first through the supply tube connecting ports 47 and the internal paths 93 of the connecting member 91 same as the first embodiment, and the ink is captured immediately by the ink absorbing material 97. Particularly, the front ends of the cylindrical portions 94 formed with the internal paths 93 are inserted into the recessions 98 of the ink absorbing material 97, and the outer circumferential surfaces 94*a* of the cylindrical portions 94 are also opposed to the ink absorbing material. Therefore, even when the container 90 is transported with the top and bottom thereof out of proper position; for example, placed with the upside down or side, the ink leaked out from the internal paths 93 can be reliably captured by the ink absorbing material 97.

Figure 11B:
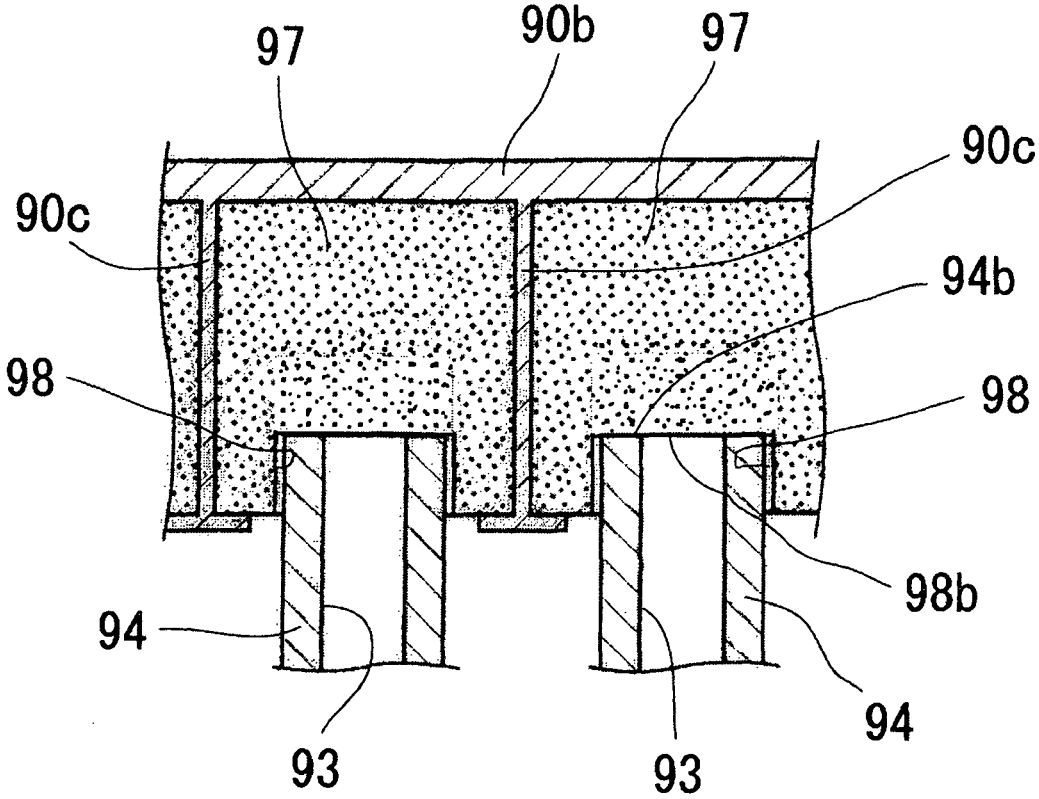
FIG. 11B is a longitudinal section showing an ink absorbing material of a modification of the embodiment.

Also, as a modification of the embodiment, the cover member 90*b* may be arranged so that, ribs 90*c* vertically extending downward from the cover member 90*b* partition the ink absorbing material 97 so as to be separately disposed corresponding to the four cylindrical portions 94 as shown in FIG. 11B. Further, the cover member 90*b* may be arranged so that the bottom faces 98*b* of the recessions 98 comes into close contact with the front-end faces 94*b* of the cylindrical portions 94. When the inkjet head is placed in the main body 90*a* and the cover member 90*b* is attached thereto, the cap 92 is elastically deformed and brought into close contact with the open face of the nozzles. Therefore, owing to the repulsive force due to the elastic deformation of the cap 92, the ink absorbing material 97 attached to the cover member 90*b* is energized to come into close contact with the front ends of the cylindrical portions 94 of the connecting member 91. In particular, although the ink absorbing material 97 is brought into close contact with the front ends of the cylindrical portions 94 to seal the same, the supply tube connecting ports 47 are communicated with the atmosphere through many fine holes or minute cavities of the ink absorbing material 97 itself. Owing to this arrangement, the ink leaked out from the supply tube connecting ports 47 during transportation can be prevented from color-mixing in the ink absorbing material 97 by the partitions as well as the capturing performance of the ink leaking out from the connecting member 91 is increased.

Needless to say, it may be arranged by combining the structures shown in FIGS. 11A and 11B, so that the ink absorbing material 97 is provided separately for each of the cylindrical portions 94 and each of them may be formed with a recession 98 corresponding to the cylindrical portions 94.

Third Embodiment

Figure 12:
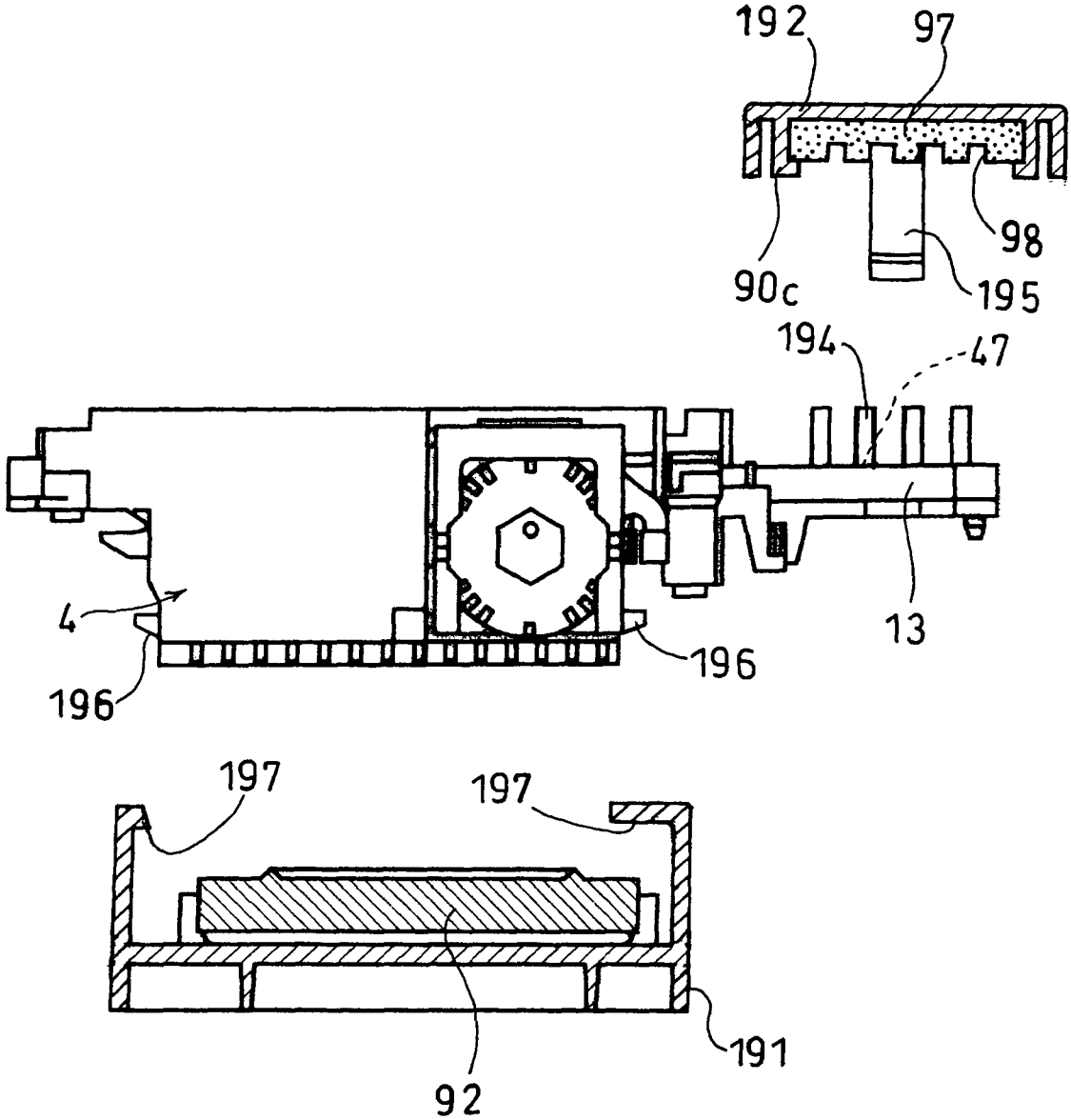
FIG. 12 is an exploded longitudinal section of a packaging structure according to an embodiment.

Further, another embodiment will be described with reference to FIG. 12. Since the embodiment is an application of the first and second embodiments, the identical elements will be given with the identical reference numerals and redundant description thereof will be omitted. The embodiment is characterized in that the entire recording head unit 4 is received and packaged in one container but a plurality of packaging means, which partially covers the recording head unit 4, is used. As a packaging means, a first packaging member 191 is detachably attached to a portion where the nozzles 22 are disposed in the recording head unit 4. Further, as a packaging means, a second packaging member 192, which is detachably attached to a portion where the supply tube connecting ports 47 are disposed in the recording head unit 4, is provided. The first packaging member 191 is formed in a substantially lid-like shape. Inside the first packaging member 191, a cap 92 identical to that in the first and second embodiments is disposed so as to cover the open face of the nozzles 22. In the portion where is formed in a substantially lid-like shape, engagement pieces 197 are formed protruding therefrom. The engagement pieces 197 can be detachably engaged with engagement receiving portions 196, which are provided on side faces of the recording head unit 4, utilizing elastic deformation thereof.

The second packaging member 192 is also formed in a substantially lid-like shape. Inside the second packaging member 192, the ink absorbing material 97 capable of covering the supply tube connecting ports 47, is provided. Since each of the supply tube connecting ports 47, which are provided corresponding to the number of the ink colors (in this embodiment, four), is formed with cylindrical portions 194 extending long toward the second packaging member 192, recessions 98 in which at least front ends of the cylindrical portions 194 are inserted in the ink absorbing material 97 like the second embodiment. The second packaging member 192 is formed with ribs 90*c* for holding the ink absorbing material 97 and the engagement pieces 195 projecting from the portion formed in a substantially lid-like shape. The engagement pieces 195 have the same structure as that of the engagement pieces 95 of the second embodiment so as to be detachably engaged with lower face of the coupling pieces 13 formed with the supply tube connecting ports 47.

As described above, in the embodiment, since it is arranged so that only the necessary portions of the recording head unit 4 are covered with packaging members, the packaging structure can be simplified. The function and effect of the cap 92 and the ink absorbing material 97 are the same as those in the first and second embodiments.

Same as the above described embodiments, the front ends of the cylindrical portions 194 and the bottom portion of the recessions 98 may be in or out of contact with each other. And by partitioning with the ribs 90*c*, the ink absorbing materials 97 may be provide separately for each of the cylindrical portions 194. Here, in view of preventing the leaked ink from being sucked again, a gape is preferably given between the front ends of the cylindrical portions 194 and the bottom portion of the recessions 98. In view of preventing the color mixture even when the ink is sucked again, it is preferred to arrange so that the ribs 90*c* (partitioning member of the ink absorbing material 97) are formed for each of the corresponding cylindrical portions 194 to separate the adjacent cylindrical portions 194 from each other.

Also, in the embodiments, although the first packaging member and the second packaging member are formed separately, they may be arranged so as to be disposed in separate positions of one container (member).

Next, an example of arrangement of the above-described dumper unit 10 will be described. The following dumper unit 10 previously stores a predetermined amount of air therein. The dumper unit 10 has an arrangement to absorb pressure fluctuation of the ink by utilizing dumping effect of the air; but is not limited thereto.

In a body case 25 of the dumper unit 10, the upper face of the lower case 27 is covered with an upper case 26. One end of the upper case 26 extends outward as the coupling piece 13 for coupling with the ink supply tube 14. The dumper unit 10 has a plurality of ink reserving chambers 30 each of which is independent from each other for each ink color, and each of the ink reserving chambers 30 is partitioned from the other ink reserving chambers 30 by a main partitioning wall 35 and sub partitioning walls 36, 37, which cross with the main partitioning wall 35. In the embodiment, a dumper functioning chamber 31*a*, which is a part of ink reserving chamber 30 (30*a*) for black ink (Bk) is disposed under the main partitioning wall 35. On the main partitioning wall 35, a buffer chamber 39, which is another part of the ink reserving chamber 30 for the black ink, an ink reserving chamber 30*b* for the cyan ink, an ink reserving chamber 30*c* for the yellow ink and an ink reserving chamber 30*d* for the magenta ink are disposed. The entire ink reserving chamber 30(30*a*, 30*b*, 30*c*, 30*d*) is structured in double layers vertically.

The lower case 27 has a lower face formed with the opening portion and the upper face, and at a position away a distance in parallel from the lower face formed with the opening portion of the lower case 27 and the upper face, the main partitioning wall 35 is formed. A lower end faces of an outer periphery wall 33 partitioning an outer periphery of the opening portion is sealed with flexible film for dumper (synthetic resin of air and liquid impermeable film) 32. A dumper functioning chamber 31*a*, which is a part of the ink reserving chamber 30*a* for the black ink is formed flatly between the flexible film 32 and main partitioning wall 35. A face sealed by the flexible film 32 is the dumper acting surface. Ribs 54, which protrude inside the dumper functioning chamber 31*a*, guide the ink from an ink flow-in port 53*a* to an ink flow-out port 42.

Figure 16:
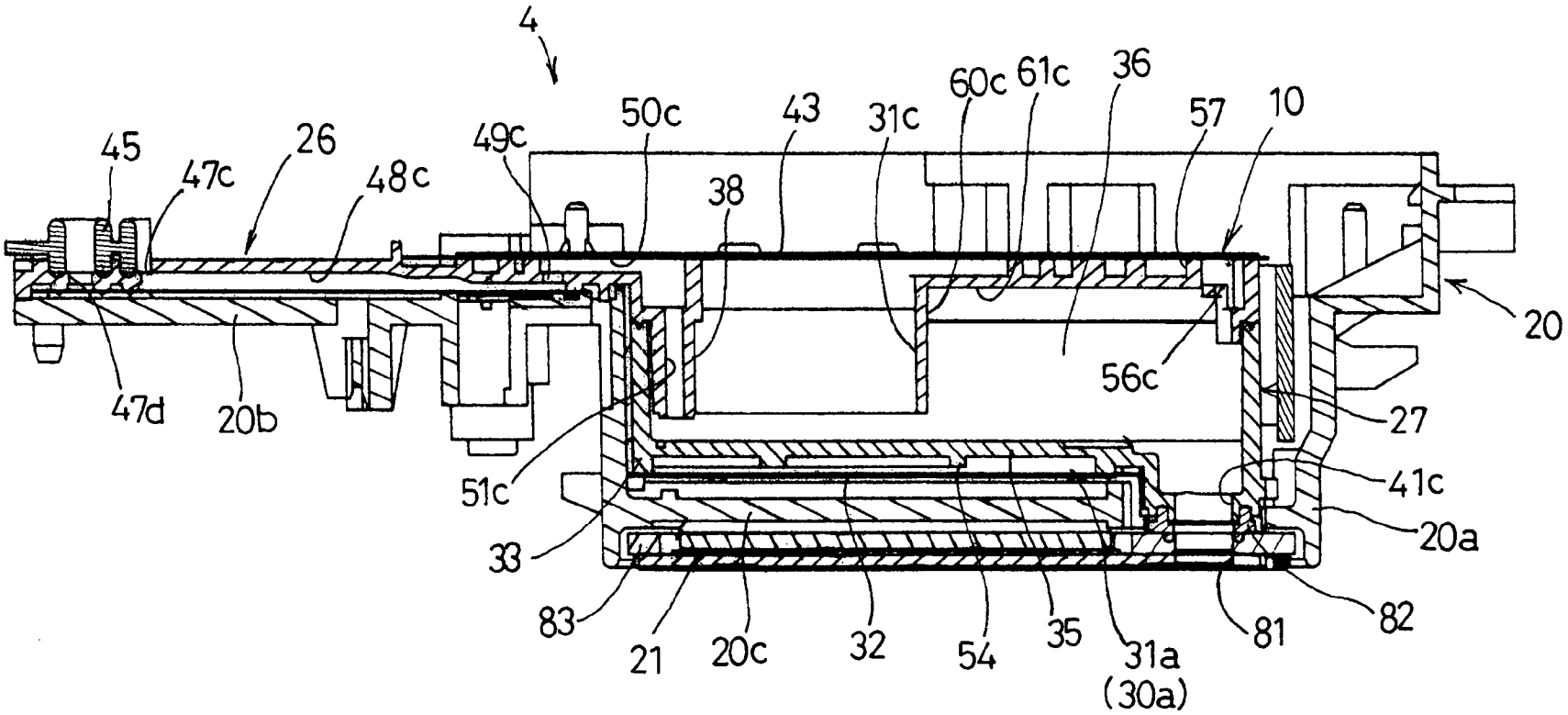
FIG. 16 is a sectional view taken from a line XVI-XVI in FIG. 15.

In the dumper unit 10, a gap for allowing the flexible film 32 to deform is ensured between the flexible film 32 and the bottom plate 20*c* of the head holder 20 as shown in FIG. 16. Each of head connecting ports 41*a* to 41*d*, which are connected to the ink supply ports 81 of the recording head 21, is opened downward in the lower face of the lower case 27 so as to face to the four ink supply ports 81 (refer to FIGS. 14A and 14B and FIG. 16).

Figure 13A:
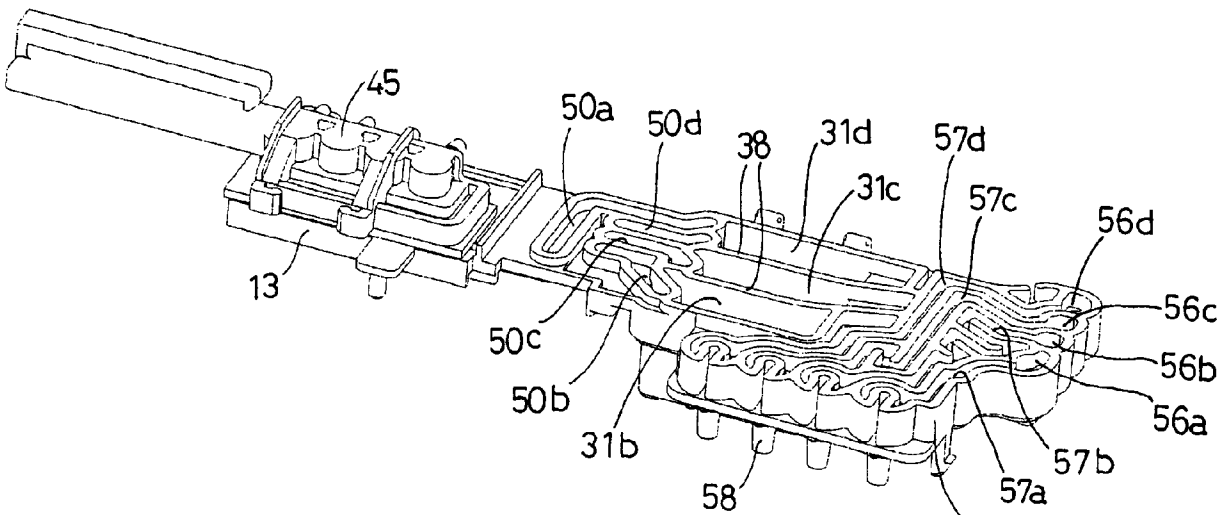
FIG. 13A is an upper perspective view of an upper case.
Figure 13B:
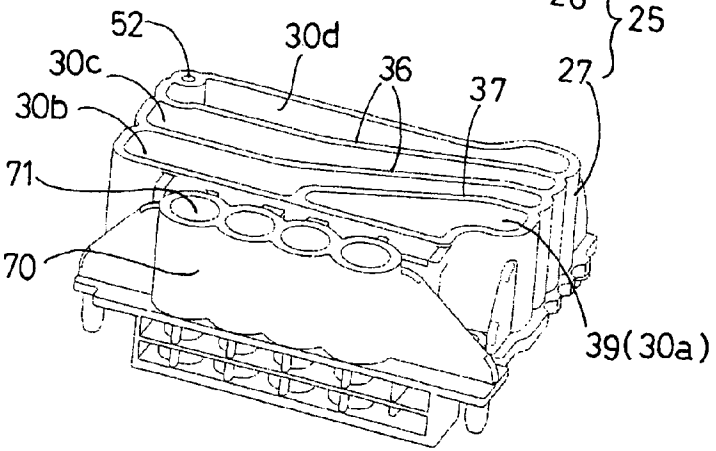
FIG. 13B is a bottom perspective view of a lower case.

The main partitioning wall 35 is formed with three ink reserving chambers 30*b* to 30*d* for each ink of cyan, yellow and magenta in the upper face thereof with two sub partitioning walls 36 and side wall of the lower case 27 as shown in FIGS. 13A and 13B. The ink reserving chambers 30*b* to 30*d* are communicated with head connecting ports 41*b* to 41*d* for ink colors (refer to FIG. 16).

Figure 17:
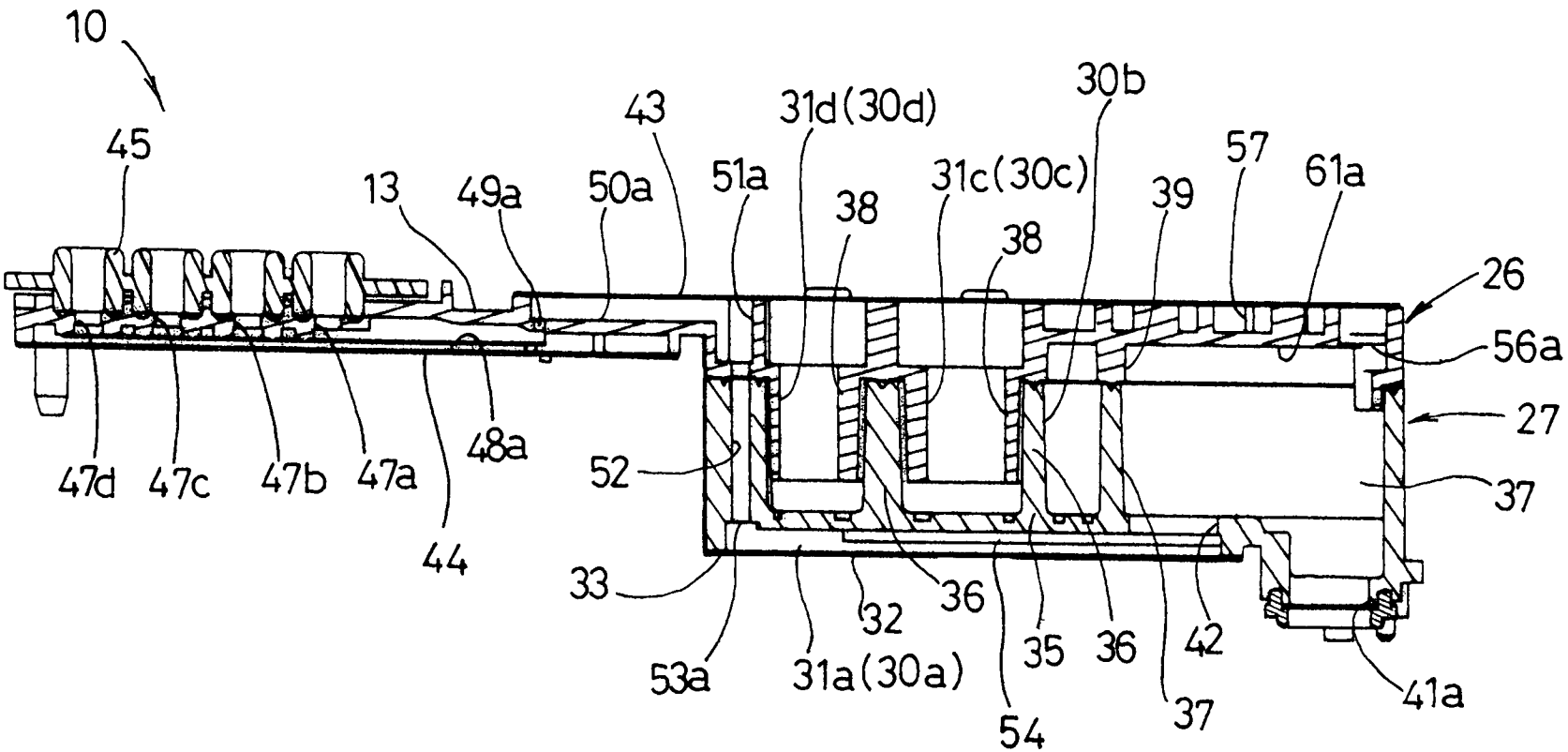
FIG. 17 is a sectional view taken from a line XVII-XVII in FIG. 15.

On the other hand, between the sub partitioning wall 37 and a side wall of the lower case 27, a buffer chamber 39, which is a part of the ink reserving chamber 30*a* for black ink, is formed in a triangle shape, viewed from the top as shown in FIGS. 13A and 13B. The ink reserving chamber 30*a* is composed of a dumper functioning chamber 31*a* and the buffer chamber 39, which are disposed vertically being interposed by the main partitioning wall 35. And in the buffer chamber 39, the head connecting port 41*a* and the ink flow-out port 42 are communicated with each other. Also, through the ink flow-out port 42, the buffer chamber 39 and the dumper functioning chamber 31*a*, which are formed vertically being interposed by the main partitioning wall 35, are communicated with each other. The buffer chamber 39 is arranged so as to once store the ink therein, and gradually accumulates the air bubbles, which are separated and floats up from the ink, to a ceiling surface 61*a* side formed by the upper case 26. The ceiling surface 61*a* is formed with an exhaust port 56*a* penetrating through the upper case 26 (refer to FIG. 17).

In the upper case 26, three ribs 38 are integrally formed extending toward the lower case 27. Three separate areas, side faces of which are enclosed by the respective ribs 38 and the top and bottom thereof are opened, are formed. These areas are received inside the respective three ink reserving chambers 30*b* to 30*d* formed in the lower case 27 (refer to FIG. 17). Each of the areas enclosed by the ribs 38 functions as a dumper functioning chamber 31*b* to 31*d* for previously storing a certain amount of air bubble from the beginning the use of inkjet printer in the respective ink reserving chambers 30*b* to 30*d* for cyan ink, yellow ink and magenta ink. The air bubbles, which are stored in the respective dumper functioning chambers 31*b* to 31*d*, are separated from the surroundings by the vertically extending ribs 38. Therefore, the certain amount (an amount prescribed by the length of the vertically extending ribs 38) of air bubbles are reliably stored without being exhausted from exhaust ports 56*b* to 56*d*, which will be described later. In order to integrally seal a portion opened above the three areas, a sheet of flexible film for the dumper (air and liquid permeable film made of synthetic resin) 43 is bonded to the upper end faces of the outer periphery wall partitioning the outer periphery of the dumper functioning chambers 31*b* to 31*d* via a adhesive or ultrasonic bonding.

Also, in the ink reserving chambers 30*b* to 30*d*, areas at the downstream of the dumper functioning chambers 31*b* to 31*d* (a side closer to the head connecting ports 41*b* to 41*d*) are formed as air bubble trap chambers 60*b* to 60*d* respectively to gradually accumulate air bubbles, which are separated and floated up from the ink. The ceiling surfaces 61*b* to 61*d* of the upper case 26 are formed with exhaust ports 56*b* to 56*d* formed penetrating them (refer to FIGS. 14A and 14B).

The supply tube connecting ports 47, which are formed through the coupling piece 13 of the upper case 26, are connected with ink supply tubes 14 being interposed by the connecting member 45 having flow paths for the respective ink colors. The upper case 26 is formed with first U-shaped flow paths 48*a* to 48*d*, which are opened downward, on the lower face thereof. The upper case 26 is further formed with first through holes 49*a* to 49*d* penetrating through between upper and bottom faces at the other end of the first U-shaped flow paths 48*a* to 48*d*. Furthermore, the upper case 26 is formed with second U-shaped flow paths 50*a* to 50*d*, which have first through holes 49*a* to 49*d* at one ends thereof, and opened upward in the upper faces. Still further, the upper case 26 is formed with second through holes 51*a* to 51*d* vertically penetrating through the upper case 26 at the other ends of the second U-shaped flow paths 50*a* to 50*d*.

For the black ink, a third through hole 52 opened at the lower side of the main partitioning wall 35 is formed penetrating through the lower case 27 being communicated with the second through hole 51*a*. The openings of three through holes 53*b* to 53*d* leads to the ink flow-in ports 53*a* to the dumper functioning chamber 31*a*. Second through holes 51*b* to 51*d* are formed integrally with the ribs 38 for the respective inks of cyan, magenta and yellow. The openings at the lower side of the second through holes 51*b* to 51*d* are ink flow-in ports 53*b* to 53*d* to the ink reserving chambers 30*b* to 30*d* respectively (refer to FIGS. 14A and 14B).

Further, in the upper case 26, upper ends of the exhaust ports 56*a* to 56*d* communicated with the buffer chamber 39 and the air bubble trap chambers 60*b* to 60*d* are connected to each of exhaust paths 57*a* to 57*d* formed in a U-like shape on the upper face of the upper case 26, and connected to the exhaust valve unit 11.

The first U-shaped flow paths 48*a* to 48*d*, which are formed on the lower face of the coupling piece 13, are integrally covered by a sheet of film member 44 bonded to the lower end of the outer periphery wall partitioning the outer periphery thereof, and formed as a flow path respectively. Also, the second U-shaped flow paths 50*a* to 50*d* and the exhaust paths 57*a* to 57*d* are integrally covered by a portion, which is the extended flexible film 43 for the dumper, and formed as a flow path respectively.

Figure 14A:
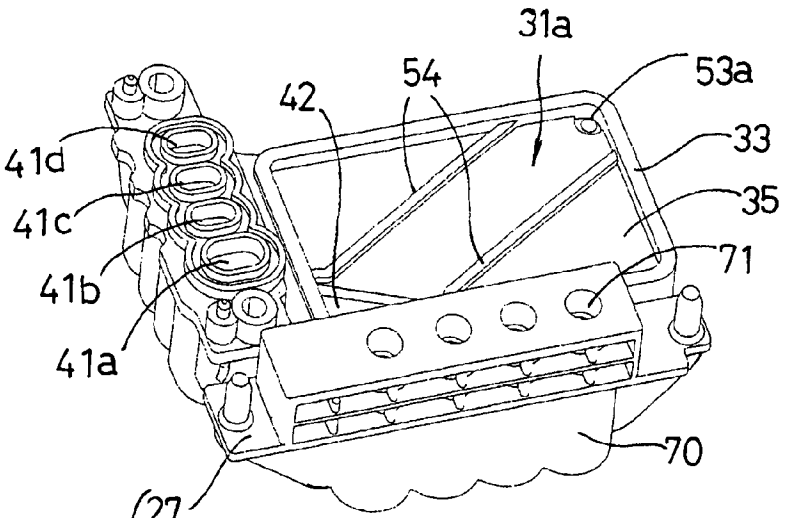
FIG. 14A is an upper perspective view of the lower case.
Figure 14B:
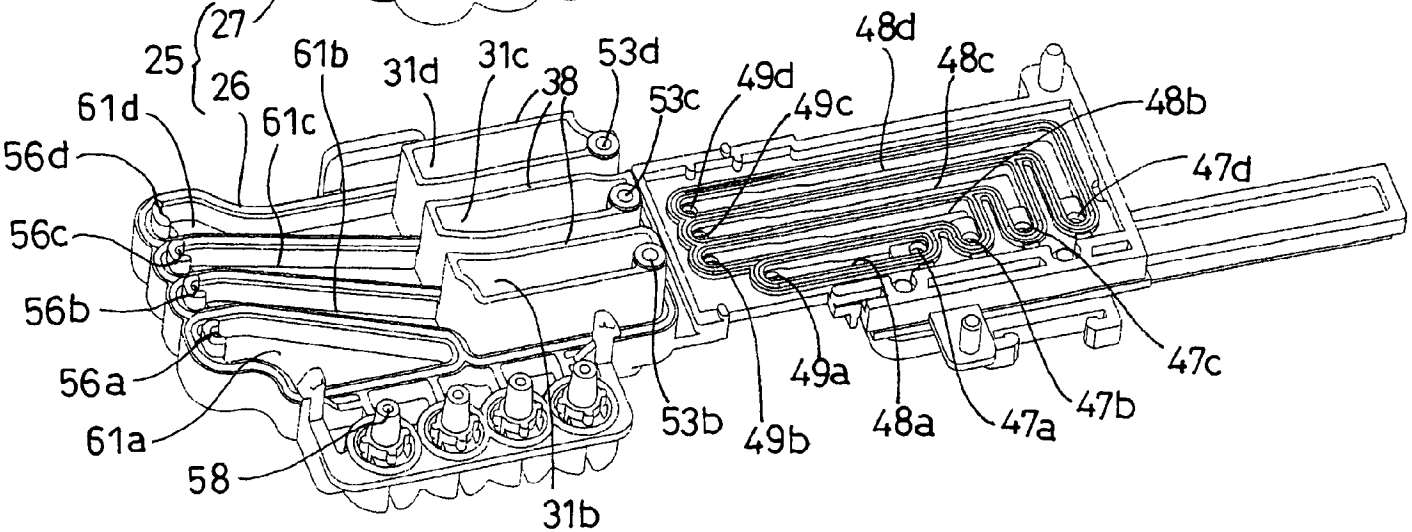
FIG. 14B is a bottom perspective view of the upper case.
Figure 15:
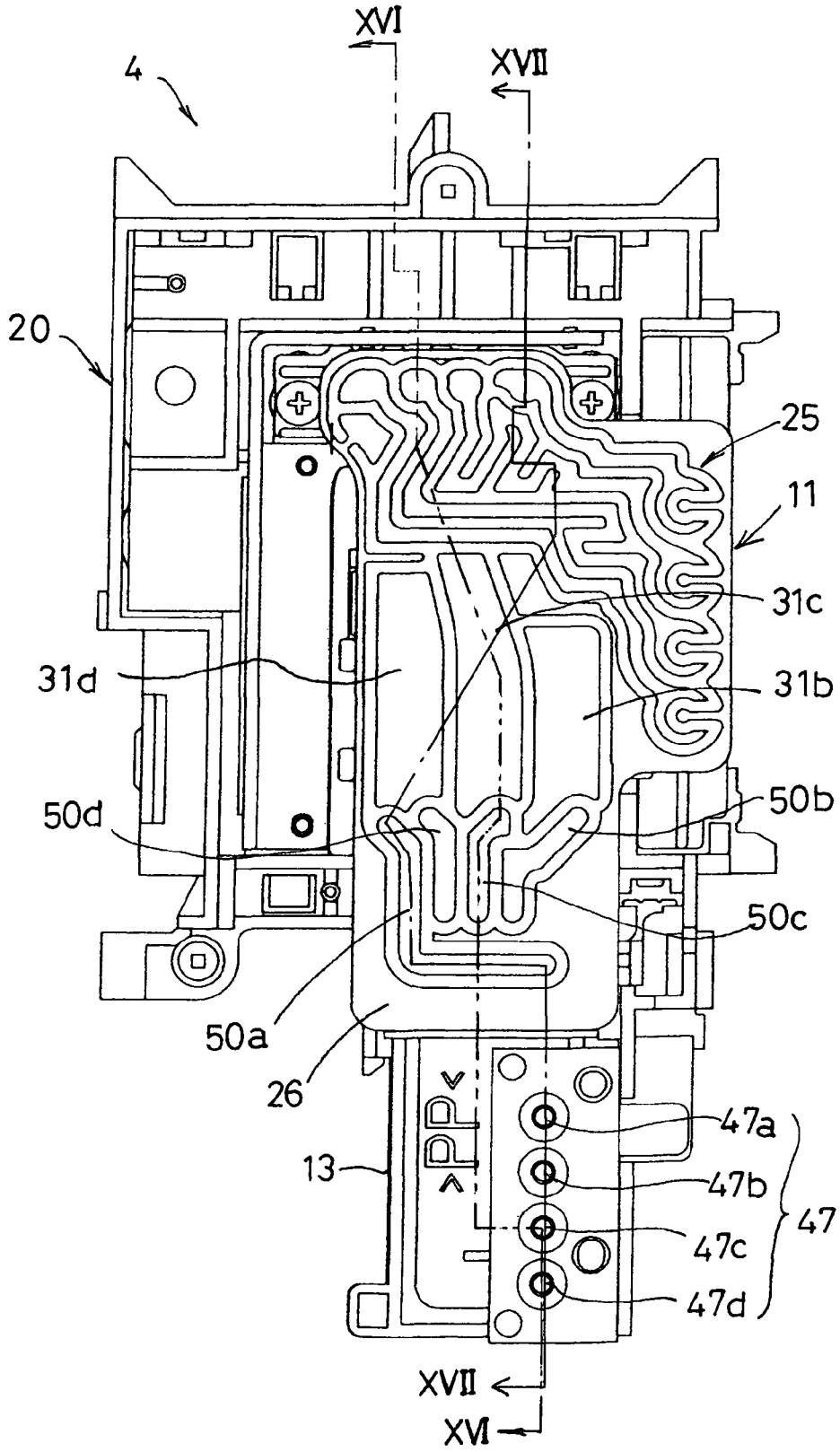
FIG. 15 is a plan view of the recording head unit from which a flexible film 43 of a dumper unit is removed.

The exhaust valve unit 11 is formed as four path holes 71 for each of the ink colors in a storing portion 70 integrally formed at one side of the lower case 27, which is longer in a vertical direction and opened at the top and bottom thereof as shown in FIG. 13B and FIG. 14A. A side wall of the upper case 26 is extended sideward up to a position so that the upper end of the storing portion 70 is covered therewith, and opening portions 58 at the other end of the exhaust paths 57*a* to 57*d* are separately connected to the upper ends of the path holes 71 respectively. Inside of the respective path hole 71, a valve (not shown) is stored respectively, and the valve is driven to open and close the opening portion at the lower end of the path holes 71. When the carriage moves to a position of a maintenance unit (not shown) in the inkjet printer, the valve is driven, the lower end opening portion of the path hole 71 is opened, and the lower end opening portion is sucked by a suction pump. Owing to this arrangement, the air bubbles in each of the ink reserving chambers 30*a* to 30*d* can be exhausted through the exhaust ports 56*a* to 56*d* and the exhaust paths 57.

According to the above-described constitution, in the case of the black ink, the ink flown into the dumper functioning chamber 31*a* through the ink flow-in port 53*a*, flows directly onto the flexible film 32 facing to the ink flow-in port 53*a* (dumper functioning face). Owing to this, the dynamic pressure of the ink can be reliably absorbed (dumped) by a wide area. The flow of the black ink is guided by the ribs 54 vertically extending from the ceiling of the dumper functioning chamber 31*a* along with the air bubbles to the ink flow-out port 42, and discharged smoothly from the ink flow-out port 42.

The black ink flown out from the ink flow-out port 42 flows into the buffer chamber 39 formed at the upper side of the main partitioning wall 35 along with the air bubbles. In the buffer chamber 39, the ink to be supplied to the recording head 21 is once reserved therein, the air bubbles are separated from the ink, and floating air bubbles are gradually accumulated at the ceiling 61*a* side thereof. And the black ink is supplied from the head connecting port 41*a* formed in the bottom portion of the buffer chamber 39 to the ink supply ports 81 for the black ink in the recording head 21.

On the other hand, the cyan ink, yellow ink, and magenta ink flow into the ink reserving chambers 30*b* to 30*d* through the ink flow-in ports 53*b* to 53*d*. In the ink reserving chamber 30*b* to 30*d*, the dumper functioning chambers 31*b* to 31*d* are disposed at the upstream side therein. The dumper functioning chambers 31*b* to 31*d* previously store a certain amount of air bubbles, and the ceiling portion thereof is covered with the flexible film 43. Owing to this, the flexible film 43 and the air bubbles absorb (dump) the dynamic pressure of the flowing inks in cooperation with each other. And the air bubbles are separated from the ink reserved in the ink reserving chambers 30*b* to 30*d*, the floating air bubbles are gradually accumulated in the air bubble trap chambers 60*b* to 60*d*.

And when the exhaust valve unit 11 is connected to a suction pump, the air bubbles accumulated in the buffer chamber 39 and the air bubble trap chambers 60*b* to 60*d* are exhausted to the outside from the respective exhaust ports 56*a* to 56*d* through the exhaust paths 57*a* to 57*d* and the exhaust valve unit 11.

In the recording head unit 4, different from the above-described dumper unit 10, even when a predetermined amount of air is not stored therein, when the recording head unit 4 is disconnected from the ink source or ink supply tube 14, the air enters into the ink flow path inside the recording head unit 4. The air expands accompanying the changes in the air pressure causing the ink to leak out. Therefore, the recording head unit 4 may not be provided with the dumper unit 10.

The above embodiments have been described as a mode for transporting the recording head unit 4 with ink stored therein for repairing or replacing the same with a new one. However, the embodiment may be applied to a recording head unit, which is shipped being filled with a preserving liquid therein.

Since recessions facing to the ink inlets are formed, and a predetermined space is ensured between the ink inlets and the ink absorbing material, even when the inside of the inkjet head changes to a negative pressure due to a pressure change after the ink has been once absorbed into the ink absorbing material, the atmosphere in the space is drawn earlier than the ink in the ink absorbing material. Therefore, the inside of the head can be prevented from being polluted by the ink returned into the head.

Since the ink absorbing material is separately provided corresponding to the ink colors, mixture of the plurality of ink colors within the ink absorbing material can be prevented. Even when the ink, which has been once absorbed by the ink absorbing material, returns into the inside of the inkjet head, the inside of the inkjet head can be prevented from being polluted by the mixed ink.

Since the openings of the nozzles of the inkjet head is covered by the cap, when the air therein is expanded due to a pressure change during transportation of the inkjet head, the ink leaks out to the outside first through the ink inlets, which are communicated with the atmosphere. And since the ink leaked from the ink inlets is immediately absorbed by the ink absorbing material covering the front ends of the connecting members at a side opposite to a portion where the ink inlets of the connecting member is attached, there is no possibility that the surroundings are polluted by the spread ink Further, the ink, which has been once absorbed by the ink absorbing material, is held in an absorbed state and hardly leaks out.

Therefore, even when the inkjet head is accidentally placed upside down during transportation thereof, there is no possibility that the ink leaks out from the ink absorbing material.

The front ends of the cylindrical portions are inserted into the recessions of the ink absorbing material. In other words, not only that the end faces of the cylindrical portions face to the bottom portions of the recessions of the ink absorbing material, but also the outer surfaces of the cylindrical portions face to the inner surfaces of the recessions of the ink absorbing material. The capturing performance of the ink absorbing material with respect to the ink leaked out from the ink inlets is increased.

Since the bottom portions of the recessions of the ink absorbing material are formed parted away from the end faces of the cylindrical portions of the connecting member, and a predetermined space is ensured between the bottom portions and the end faces, even when the inside of the inkjet head changes into a negative pressure due to a pressure change after the ink has been absorbed once in the ink absorbing material, the atmosphere in the space is sucked earlier than the ink in the ink absorbing material. Accordingly, the inside of the head can be prevented from being polluted by the returned ink.

Since the ink absorbing material is separately provided corresponding to the ink colors, a plurality of ink colors can be prevented from being mixed in the ink absorbing material. Even when the ink, which has been once absorbed by the ink absorbing material, returns into the inkjet head, the inside of the inkjet head can be prevented from being polluted by the mixed ink.

Only by attaching the second packaging means to the inkjet head, the ink absorbing material is disposed in a proper position with respect to the inkjet head.

In a state that the inkjet head is placed on the main body, when the cover member is attached thereto, the cap made of a rubber elastic material is brought into a close contact with the open face of the nozzles. At the same time, owing to the elasticity of the cap, the ink absorbing material is energized in a direction to come into close contact with the ink inlets or front ends of the connecting member; thus, the capturing performance with respect to the ink leaked out from the ink inlets or the front ends of the connecting member is increased.

The packaging means, which does not receives the entire of the inkjet head in the container but partially covers the inkjet head, is used. Therefore, only necessary portions; i.e., only the portions corresponding to the openings of the nozzles and the ink inlets have to be attached with the packaging means. Accordingly, the following effects can be obtained; i.e., the packaging structure can be simplified and miniaturized.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. A packaging structure of an inkjet head for transporting thereof with a liquid stored therein, the inkjet head including an ink inlet of ink supplied from an ink source and a nozzle communicated with the ink inlet for discharging the ink to a recording medium, comprising:

a first packaging member including a cap for covering an opening of said nozzle, the first packaging member being detachably attached to the opening of said nozzle; and a second packaging member including an ink absorbing material for covering said ink inlet, the second packaging member being detachably attached to said ink inlet, wherein said ink absorbing material is formed with a recess facing to said ink inlet, open end faces of said recess and open end faces of said ink inlets are in close contact with each other.

2. The packaging structure of an inkjet head according to claim 1, wherein each ink inlet corresponding to each of discharging ink colors is disposed in line, and said ink absorbing material is separately disposed for each ink inlet.

3. The packaging structure of an inkjet head according to claim 1, wherein each ink inlet corresponding to each of discharging ink colors is disposed in line, and said ink absorbing material is separately disposed for each ink inlet.

4. The packaging structure of an inkjet head according to claim 1, wherein said cap covers a surface of said inkjet head including the opening of said nozzle to seal the surface thereof.

5. The packaging structure of an inkjet head according to claim 4, wherein a side of said cap facing to said surface is spaced from said surface.

6. The packaging structure of an inkjet head according to claim 1, wherein said ink absorbing material is held by the second packaging member, facing to said ink inlet.

7. The packaging structure of an inkjet head according to claim 1, wherein each of said first packaging member and said second packaging member partially covers said inkjet head, said first packaging member is detachably attached to said inkjet head so as to cover over said nozzle, said second packaging means is detachably attached to said inkjet head so as to cover the vicinity of said ink inlets.

8. The packaging structure of an inkjet head according to claim 1, wherein said liquid is an ink or an preserving liquid.

9. A packaging structure of an inkjet head for transporting thereof with a liquid stored therein, the inkjet head including ink inlets of ink supplied from ink sources and nozzle communicated with the ink inlets for discharging the ink to a recording medium, comprising:

a container for accommodating said inkjet head, which includes a main body having a bottom portion on which said inkjet head is placed and an upper portion having an opening, and a cover member which is detachably attached to said main body so that a ceiling thereof covers the opening; an ink absorbing material for covering said ink inlet; and a cap for covering an opening of said nozzle, wherein said ink absorbing material is disposed in one of said bottom portion and said ceiling, said cap is made of an elastic material and disposed in the other of said bottom portion and said ceiling, and when said cover member is attached to said main body with said inkjet head placed on said bottom portion, said ink absorbing material seals said ink inlet via elasticity of said cap with respect to the opening of said nozzle.

10. A packaging structure of an inkjet head for transporting thereof with a liquid stored therein, the inkjet head including ink inlets of ink supplied from ink sources and nozzle communicated with the ink inlets for discharging the ink to a recording medium, comprising:

a first packaging member including a cap for covering opening of said nozzle, the first packaging member being detachably attached to the opening of said nozzle; and a second packaging member including an ink absorbing material for absorbing said liquid, wherein a connecting member, which connects said ink inlets to said ink absorbing material so as to allow said ink inlet to be communicated with the atmosphere through said ink absorbing material, is detachably attached to said ink inlet, said ink absorbing material covers an end opposite to said ink inlet of said connecting member, and said second packaging member is detachably attached to said connecting member.

11. The packaging structure of an inkjet head according to claim 10, wherein said connecting member includes a cylindrical portion opposing to a part thereof attaching to said ink inlet, and at least an end of said cylindrical portion is inserted in a recess formed in said ink absorbing material.

12. The packaging structure of an inkjet head according to claim 11, wherein an inner surface of said recess is adjacent to an outer surface of said cylindrical portion or in contact therewith, and a bottom of said recess is spaced from an end face of said cylindrical portion.

13. The packaging structure of an inkjet head according to claim 12, wherein each ink inlet corresponding to each of discharging ink colors is disposed in line, each connecting member corresponding to each of said discharging ink colors is provided, and each ink absorbing material is separately disposed for each connecting member.

14. The packaging structure of an inkjet head according to claim 11, wherein each ink inlet corresponding to each of discharging ink colors is disposed in line, each connecting member corresponding to each of said discharging ink colors is provided, and each ink absorbing material is separately disposed for each connecting member.

15. The packaging structure of an inkjet head according to claim 10, wherein said ink absorbing material is held by the second packaging member, facing to said connecting members.

16. The packaging structure of an inkjet head according to claim 10, wherein said cap covers a surface of said inkjet head including the opening of said nozzle to seal the surface.

17. The packaging structure of an inkjet head according to claim 16, wherein a side of said cap facing to said surface is spaced from said surface.

18. The packaging structure of an inkjet head according to claim 10, wherein said liquid is an ink or an preserving liquid.

19. The packaging structure of a inkjet head according to claim 10, wherein each of said first packaging member and said second packaging member partially covers said inkjet head, said first packaging member is detachably attached to said inkjet head so as to cover over said nozzle, said second packaging means is detachably attached to said inkjet head so as to cover over said ink inlet.

20. A packaging structure of an inkjet head for transporting thereof with a liquid stored therein, the inkjet head including ink inlets of ink supplied from ink sources and nozzle communicated with the ink inlets for discharging the ink to a recording medium, comprising:

a container for accommodating said inkjet head, which includes a main body having a bottom portion on which said inkjet head is placed and an upper portion having an opening, and a cover member which is detachably attached to said main body so that a ceiling thereof covers the opening; an ink absorbing material for covering said ink inlet;

a cap for covering an opening of said nozzle; and a connecting member, which connects said ink inlets to said ink absorbing material so as to allow said ink inlet to be communicated with an atmosphere through said ink absorbing material, is detachably attached to said ink inlet, wherein said ink absorbing material is disposed in one of said bottom portion and said ceiling, said cap is made of an elastic material and disposed in the other of said bottom portion and said ceiling, and when said cover member is attached to said main body with said inkjet head placed on said bottom portion, said ink absorbing material seals an end of said connecting member via elasticity of said cap with respect to the opening of said nozzle.

21. A packaging structure of an inkjet head for transporting thereof with a liquid stored therein, the inkjet head including an ink inlet of ink supplied from an ink source and a nozzle communicated with the ink inlet for discharging the ink to a recording medium, comprising:

a first packaging member including a cap for covering an opening of said nozzle, the first packaging member being detachably attached to the opening of said nozzle; and a second packaging member including an ink absorbing material for covering said ink inlet, the second packaging member being detachably attached to said ink inlet, wherein each ink inlet corresponding to each of discharging ink colors is disposed in line, and said ink absorbing material is separately disposed for each ink inlet.

* * * * *